US009963903B2

(12) United States Patent
Choi

(10) Patent No.: US 9,963,903 B2
(45) Date of Patent: May 8, 2018

(54) TOP CONNECTING APPARATUS FOR A SHELTER FRAME

(71) Applicant: Campvalley (Xiamen) Co. Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days. days.

(21) Appl. No.: 15/595,721

(22) Filed: May 15, 2017

(65) Prior Publication Data

US 2017/0247907 A1 Aug. 31, 2017

Related U.S. Application Data

(63) Continuation of application No. 14/478,168, filed on Sep. 5, 2014, now Pat. No. 9,650,805.

(30) Foreign Application Priority Data

| | | |
|---|---|---|
| Dec. 5, 2013 | (CN) | 2013 2 0790035 U |
| Jan. 13, 2014 | (CN) | 2014 2 0018601 U |
| Jan. 22, 2014 | (CN) | 2014 2 0039449 U |
| Jan. 24, 2014 | (CN) | 2014 2 0045744 U |
| Jul. 2, 2014 | (CN) | 2014 2 0362299 U |
| Jul. 2, 2014 | (CN) | 2014 2 0362308 U |

(51) Int. Cl.
*E04H 15/32* (2006.01)
*E04H 15/48* (2006.01)

(52) U.S. Cl.
CPC ..... *E04H 15/32* (2013.01); *E04H 15/48* (2013.01)

(58) Field of Classification Search
CPC ..... A45B 25/06; A45B 25/10
USPC ..... 135/135, 147, 159, 120.3
See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy |
| 1,129,194 | A | 2/1915 | Hanley |
| 1,347,107 | A | 7/1920 | McCann |
| 2,113,118 | A | 4/1938 | Pyatt |
| 2,137,625 | A | 11/1938 | Norvell |
| 2,227,554 | A | 1/1941 | Riordon |

(Continued)

FOREIGN PATENT DOCUMENTS

| | | | |
|---|---|---|---|
| CA | 2 022 369 | A1 | 2/1991 |
| CN | 1076987 | A | 10/1993 |

(Continued)

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed is an apparatus for folding and unfolding a shelter frame, e.g., a tent. A plurality of radially arranged connecting bosses is situated on a connecting piece. A pivoting member pivotally attaches to the connecting boss, and a shelter frame rod attaches to the pivoting member. In the folded position, the pivoting members are rotated toward the center of the apparatus. In the unfolded position, the pivoting members are rotated away from the center of the apparatus. The apparatus is rapidly and easily assembled.

10 Claims, 24 Drawing Sheets

(56) References Cited

U.S. PATENT DOCUMENTS

| | | | |
|---|---|---|---|
| 2,306,706 | A | 12/1942 | Lucas |
| 2,448,895 | A | 9/1948 | Lawrence |
| 2,530,765 | A | 11/1950 | Greenup |
| 2,555,220 | A | 5/1951 | Brown |
| 2,716,993 | A | 9/1955 | Coderick |
| 2,731,972 | A | 1/1956 | Braun |
| 2,948,287 | A | 8/1960 | Rupert |
| 2,962,034 | A | 11/1960 | Finlayson |
| 2,984,249 | A | 5/1961 | Sears, Jr. et al. |
| 3,054,413 | A | 9/1962 | Eshelman |
| 3,333,373 | A | 8/1967 | Taylor et al. |
| 3,738,378 | A | 6/1973 | Williams |
| 3,810,482 | A | 5/1974 | Beavers |
| 3,929,146 | A | 12/1975 | Maiken |
| 4,077,417 | A | 3/1978 | Beavers |
| 4,148,332 | A | 4/1979 | Huddle |
| 4,201,237 | A | 5/1980 | Watts et al. |
| 4,280,521 | A | 7/1981 | Zeigler |
| 4,285,354 | A | 8/1981 | Beavers |
| 4,627,210 | A | 12/1986 | Beaulieu |
| 4,637,748 | A | 1/1987 | Beavers |
| 4,750,509 | A | 6/1988 | Kim |
| 4,787,182 | A | 11/1988 | Serge |
| 4,819,680 | A | 4/1989 | Beavers |
| 4,838,003 | A | 6/1989 | Zeigler |
| 4,941,499 | A | 7/1990 | Pelsue et al. |
| 4,944,321 | A | 7/1990 | Moyet-Ortiz |
| 4,971,090 | A | 11/1990 | Uhl |
| 4,998,552 | A | 3/1991 | Niksic et al. |
| 5,230,358 | A | 7/1993 | Forell |
| 5,263,507 | A | 11/1993 | Chuang |
| 5,293,890 | A | 3/1994 | Park et al. |
| 5,328,286 | A | 7/1994 | Lee |
| 5,333,634 | A | 8/1994 | Taylor |
| 5,361,794 | A | 11/1994 | Brady |
| 5,423,341 | A | 6/1995 | Brady |
| 5,617,681 | A | 4/1997 | Lyons |
| 5,628,338 | A | 5/1997 | Stumbo |
| 5,634,483 | A | 6/1997 | Gwin |
| 5,666,986 | A | 9/1997 | Fox |
| 5,701,923 | A | 12/1997 | Losi, Jr. et al. |
| 5,732,726 | A | 3/1998 | Lee |
| 5,771,651 | A | 6/1998 | Shiina |
| 5,797,695 | A | 8/1998 | Prusmack |
| 5,884,646 | A | 3/1999 | Ju |
| 5,943,837 | A | 8/1999 | Esser et al. |
| 6,021,795 | A | 2/2000 | Long et al. |
| 6,032,430 | A | 3/2000 | Soukup |
| 6,167,898 | B1 | 1/2001 | Larga et al. |
| 6,283,136 | B1 | 9/2001 | Chen |
| 6,286,530 | B1 | 9/2001 | Hussey |
| 6,296,415 | B1 | 10/2001 | Johnson et al. |
| 6,463,948 | B2 | 10/2002 | Lee |
| 6,516,823 | B1 | 2/2003 | Gioveret et al. |
| 6,591,571 | B2 | 7/2003 | Fritsche et al. |
| 6,604,844 | B2 | 8/2003 | Hussey |
| 6,666,223 | B2 | 12/2003 | Price et al. |
| 6,772,780 | B2 | 8/2004 | Price |
| 6,776,179 | B1 | 8/2004 | Chen |
| 6,854,476 | B1 | 2/2005 | Chai |
| 6,868,858 | B2 | 3/2005 | Suh |
| 6,874,519 | B2 | 4/2005 | Chiang |
| 6,892,744 | B2 | 5/2005 | Feldpausch et al. |
| 7,025,075 | B2 | 4/2006 | Suh |
| 7,040,585 | B2 | 5/2006 | Cheng et al. |
| 7,059,094 | B2 | 6/2006 | Yamawaki |
| D544,941 | S | 6/2007 | Rogers |
| 7,311,113 | B2 | 12/2007 | Suh |
| 7,316,239 | B2 | 1/2008 | Yang |
| 7,392,610 | B2 | 7/2008 | Jedlicka et al. |
| RE40,544 | E | 10/2008 | Suh |
| 7,481,235 | B2 | 1/2009 | Prusmack |
| 7,546,845 | B2 | 6/2009 | Prusmack |
| 7,607,447 | B1 | 10/2009 | Han |
| 7,628,165 | B2 | 12/2009 | Rothweil |
| 7,656,024 | B2 | 2/2010 | Elbanhawy |
| 7,686,024 | B1 * | 3/2010 | Lai ..... A45B 25/02 135/29 |
| 7,861,736 | B2 | 1/2011 | Choi |
| 7,891,367 | B2 * | 2/2011 | Ma ..... A45B 25/02 135/19.5 |
| 8,047,218 | B1 | 11/2011 | Shin |
| 8,069,872 | B2 | 12/2011 | Bae |
| 8,469,045 | B2 | 6/2013 | Zhou |
| 8,485,208 | B2 | 7/2013 | Seo |
| D705,884 | S | 5/2014 | Jin |
| 8,910,648 | B2 | 12/2014 | Jin |
| 2001/0050098 | A1 | 12/2001 | Lee |
| 2003/0005953 | A1 | 1/2003 | Erbetta et al. |
| 2006/0016467 | A1 | 1/2006 | Bae |
| 2006/0289048 | A1 | 12/2006 | Choi |
| 2007/0051399 | A1 | 3/2007 | Jung |
| 2007/0215192 | A1 | 9/2007 | Hoffman |
| 2012/0318316 | A1 | 12/2012 | Choi et al. |
| 2013/0014794 | A1 | 1/2013 | Jin |
| 2013/0318316 | A1 | 11/2013 | Yamada |
| 2014/0076372 | A1 | 3/2014 | Jin |
| 2014/0109945 | A1 | 4/2014 | Jin |
| 2014/0246062 | A1 | 9/2014 | Ma |
| 2014/0261601 | A1 | 9/2014 | Jin |
| 2014/0290710 | A1 | 10/2014 | Choi |
| 2015/0068573 | A1 | 3/2015 | Jin |
| 2015/0083177 | A1 | 3/2015 | Hotes |
| 2015/0167343 | A1 | 6/2015 | Fang |
| 2015/0284974 | A1 | 10/2015 | Choi |

FOREIGN PATENT DOCUMENTS

| | | | |
|---|---|---|---|
| CN | 2506736 | Y | 8/2002 |
| CN | 2635827 | Y | 8/2004 |
| CN | 2697225 | Y | 5/2005 |
| CN | 201013097 | Y | 1/2008 |
| CN | 201103269 | Y | 8/2008 |
| CN | 201129060 | Y | 10/2008 |
| CN | 201220478761.4 | | 9/2012 |
| CN | 202767622 | U | 3/2013 |
| CN | 203034904 | U | 3/2013 |
| FR | 1 121 851 | | 8/1956 |
| FR | 68588 | | 5/1958 |
| GB | 2 201 703 | A | 9/1988 |
| GB | 2 259 927 | A | 3/1993 |
| KR | 10-2011-0054253 | A | 5/2011 |
| WO | WO 2011/022764 | A1 | 3/2011 |

* cited by examiner

A–A

B–B

TOP CONNECTING APPARATUS FOR A SHELTER FRAME

CROSS-REFERENCE TO RELATED APPLICATIONS

This application is a Continuation of U.S. application Ser. No. 14/478,168, filed Sep. 5, 2014, which claims priority to Chinese Application No. 201420362308.6, filed Jul. 2, 2014, Chinese Application No. 201420362299.0, filed Jul. 2, 2014, Chinese Application No. 201420045744.0, filed Jan. 24, 2014, Chinese Application No. 201420039449.4, filed Jan. 22, 2014, Chinese Application No. 201420018601.0, filed Jan. 13, 2014, and Chinese Application No. 201320790035.0, filed Dec. 5, 2013, the entire contents of which applications are incorporated herein for all purposes by this reference.

FIELD

This disclosure relates to apparatuses for folding and unfolding a shelter frame, e.g., a tent.

BACKGROUND

A top connecting hub connects to tent top levers. Since the tent is required to be foldable, the top levers and connecting piece are pivotally connected to realize the foldable property. When a common tent is folded, the tent top levers are typically folded downward or upward with respect to the connecting hub.

As shown in a prior art tent top connecting hub depicted in FIG. 1, pivoting nests 11' are arranged on a connecting seat 1' for receiving tent top levers 2'. An inner wall of pivoting nest 11' is provided with a curved groove 13'. A baffle 12' is formed on a lower surface of pivoting nest 11', which serves to block a pivoting point between pivoting nest 11' and top lever 2'. A pivoting sleeve 3' is fixed at an end of each top lever 2', and has an outer diameter not larger than a width of pivoting nest 11'. A curved bump 31' is arranged on the outer surface of pivoting sleeve 3', which corresponds to curved groove 13'. The end of pivoting sleeve 3' is pivoted to an inner end of pivoting nest 11' by means of pivoting piece 4', so that each top lever 2' rotates upward with respect to connecting seat 1'. When connecting seat 1' is assembled to each of tent top levers 2', pivoting nest 11' is arranged upward. When the tent is in an unfolded state, the supporting rod of the tent body is limited, and tent top levers 2' can support connecting seat 1' by means of its tensile force. Pivoting sleeve 3' is accommodated in pivoting nest 11', and is embedded in curved groove 13' of pivoting nest 11' by means of its curved bump 31', thus realizing the function of further limiting of position. Baffle 12' blocks the outer side of the pivoting point of pivoting sleeve 3' to restrict tent top levers 2' from rotating downward with respect to connecting seat 1'.

In the above-mentioned tent top connecting hub, pivoting nest 11' should be arranged on connecting seat 1', and pivoting sleeve 3' which can be engaged with pivoting nest 11', should be fixed to the head portion of top lever 2'. In such a connecting structure, pivoting nest 11' is relatively complicated in structure, thus complicating the tent top structure. In addition, each pivoting nest 11' on connecting seat 1' is required to engage with movable pivoting sleeve 3', thus significantly increasing difficulty in manufacturing connecting seat F. A slight error during manufacturing may lead to loose mating between pivoting sleeve 3' and pivoting nest 11'. As a consequence, top lever 2', when connected to connecting seat 1', suffers from an unstable connection, which may result in defects during usage.

BRIEF DESCRIPTION OF THE DRAWINGS

The subject matter disclosed is illustrated by way of example and not by way of limitation in the figures of the accompanying drawings, in which like reference numerals refer to similar elements, and in which.

Figure 1:
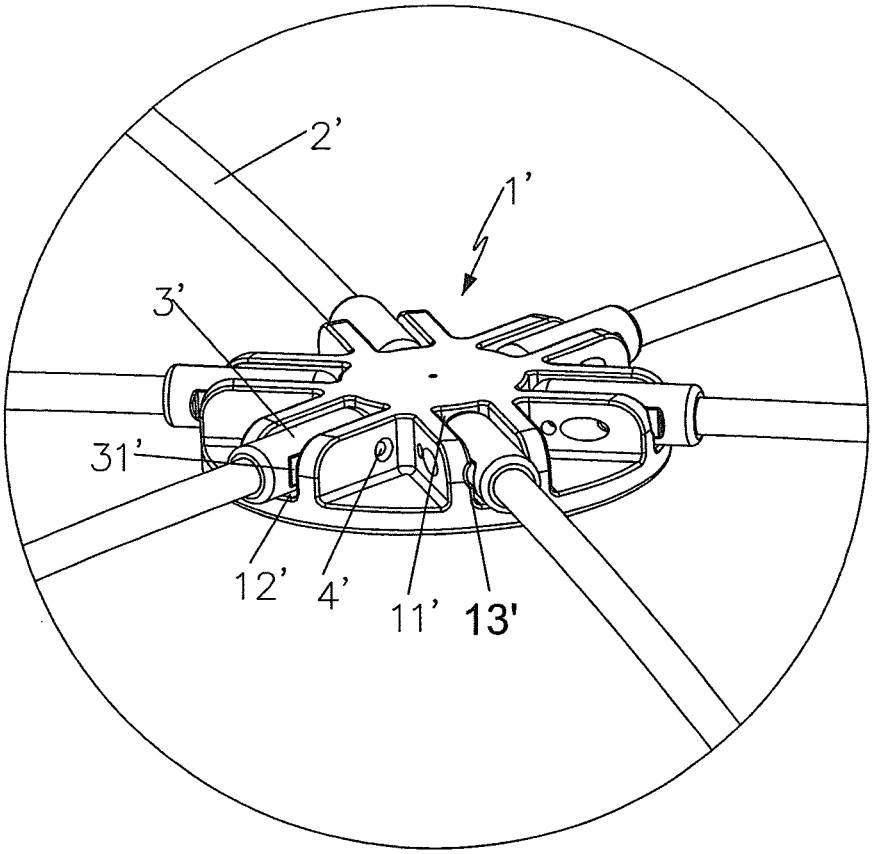
FIG. 1 depicts a structural view of a prior art connecting hub.
Figure 2:
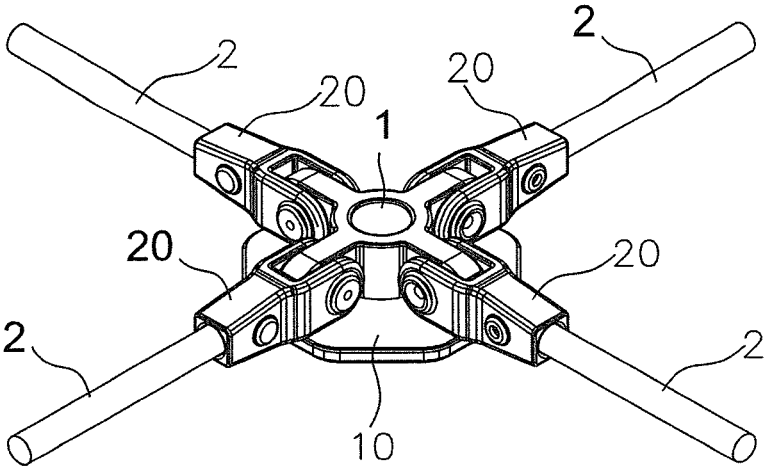
FIG. 2 depicts a structural view illustrating an unfolded state of a top connecting apparatus in accordance with one embodiment.
Figure 3:
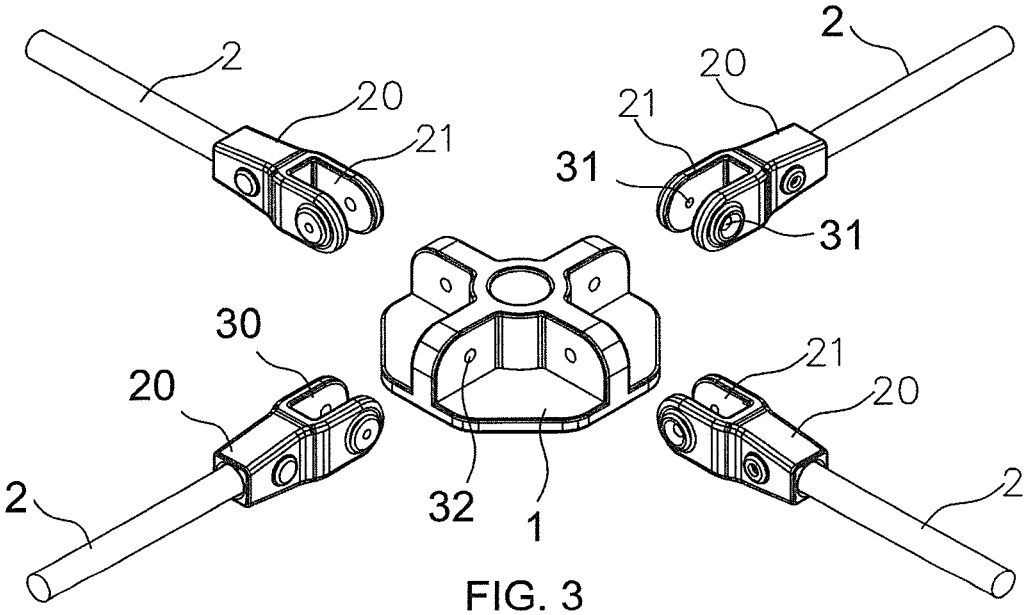
FIG. 3 depicts an exploded structural view in accordance with one embodiment.
Figure 4:
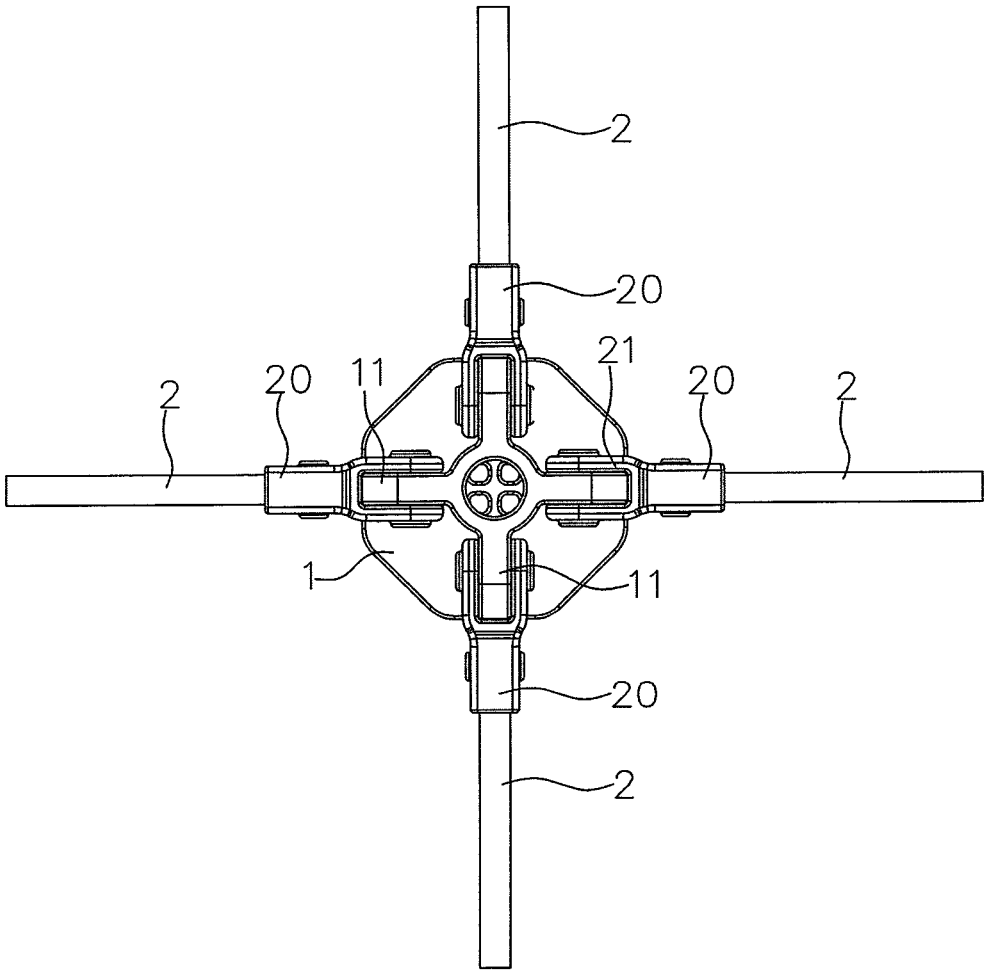
FIG. 4 depicts a top view in accordance with one embodiment.
Figure 5:
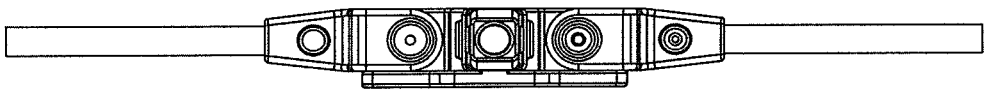
FIG. 5 is a side view in accordance with one embodiment.

Reference numerals used in relation to FIGS. 30-35 are identified as follows: central pedestal 401; pivoting member 402; connecting piece 403; connecting boss 411; embossment 412; connecting slot 413; arc surface 414; guiding surface 415; female buckle structure 416; groove 417; arc gear face 418; limit surface 419; bifurcated coupler link 421; connecting rod part 422; link slot 423; link sidewall 424; pin hole 425; lug 426; pillar 427; attachment portion 428; lateral boss 431; and profile plane 432.

Reference numerals used in relation to FIGS. 36-41 are identified as follows: central pedestal 501; pivoting member 502; connecting piece 503; connecting boss 511; screw 512; connecting slot 513; arc surface 514; screw hole 515; female buckle structure 516; groove 517; arc gear face 518; limit surface 519; bifurcated coupler link 521; connecting rod part 522; link slot 523; link sidewall 524; pin hole 525; lug 526; pillar 527; attachment portion 528; lateral boss 531; and profile plane 532.

DETAILED DESCRIPTION

In the description that follows, terms "interior" or "inner" refer to locations of items that are closer to the center of the apparatus than similar items located farther from the center; vice-versa for terms "exterior" or "outer."

FIGS. 2-6 depict a top connecting apparatus in accordance with one embodiment. The top connecting apparatus comprises a connecting piece, e.g., connecting seat 1. The central portion of connecting seat 1, e.g., a central pedestal, is denoted as reference numeral 1 in FIG. 2. Connecting bosses, e.g., strip-shaped connecting blocks 11, are radially arranged on connecting seat 1, and correspond to a number of shelter rods, e.g., tent top levers 2. Connecting block 11 includes first and second sidewalls, a top portion, a bottom portion (adjacent to the connecting piece), an outer portion, an inner portion, and a first pivoting structure. In this embodiment, connecting seat 1 is provided with four connecting blocks 11, which are distributed crosswise on connecting seat 1, and the transition between the top and outer portions is curved. A head portion of top lever 2 is connected to a pivoting member, e.g., connector 20. Connector 20 includes a connecting rod part, which further includes an attachment portion for connecting top lever 2 to the connecting rod part, and a pin hole for securing top lever 2 to the connecting rod part. Connector 20 is pivotally connected to connecting block 11 to realize the connection of top lever 2. Connector 20 is provided with a bifurcated coupler link having a link slot comprising first and second link sidewalls, e.g., a pivoting open groove 21. By pivoting the pivoting open groove 21 into connecting block 11, top lever 2 can be pivotally connected to seat 1.

Pivoting open grooves 21 and connecting blocks 11 can be directly pivoted by means of a pillar, e.g., a pin. In this case, the first pivoting structure comprises a connecting hole, e.g., a pivoting hole 32. Pivoting hole 32 is arranged in and penetrates through connecting block 11. Pivoting hole 32 is located at a position near the center of connecting block 11. A second pivoting structure is comprised of pivoting hole 31 and a pin. Pivoting hole 31 is arranged respectively in two corresponding sheet bodies 30 of pivoting open groove 21 at a position facing pivoting hole 32. A pin (not shown) is connected through pivoting hole 32 and pivoting hole 31. By means of the pin, pivoting open groove 21 is pivotally connected into connecting block 11 of connecting seat 1, thereby pivotally connecting top lever 2 to connecting seat 1. In connecting seat 1, a baffle 10 is arranged at a lower portion of connecting block 11 for limiting top lever 2 from rotating downward with respect to connecting seat 1. Baffle 10 blocks a pivoting point between connecting block 11 and connector 20 of top lever 2, so as to ensure that top lever 2 can be supported in an unfolded state.

Figure 6:
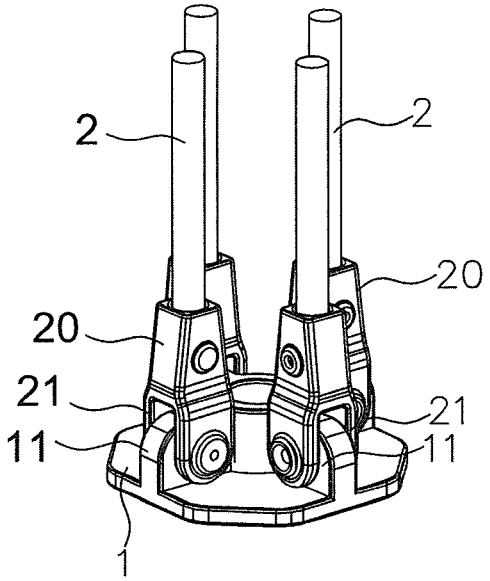
FIG. 6 depicts a schematic view illustrating a folded state in accordance with one embodiment.

When the shelter, e.g., tent, is unfolded, pivoting open grooves 21 at the head portions of top levers 2 are connected into connecting blocks 11 of connecting seat 1, and lower ends of pivoting open grooves 21 rest against connecting seat 1. When it is intended to fold tent top levers 2, connector 20 is folded upward as depicted in FIG. 6.

Figure 7:
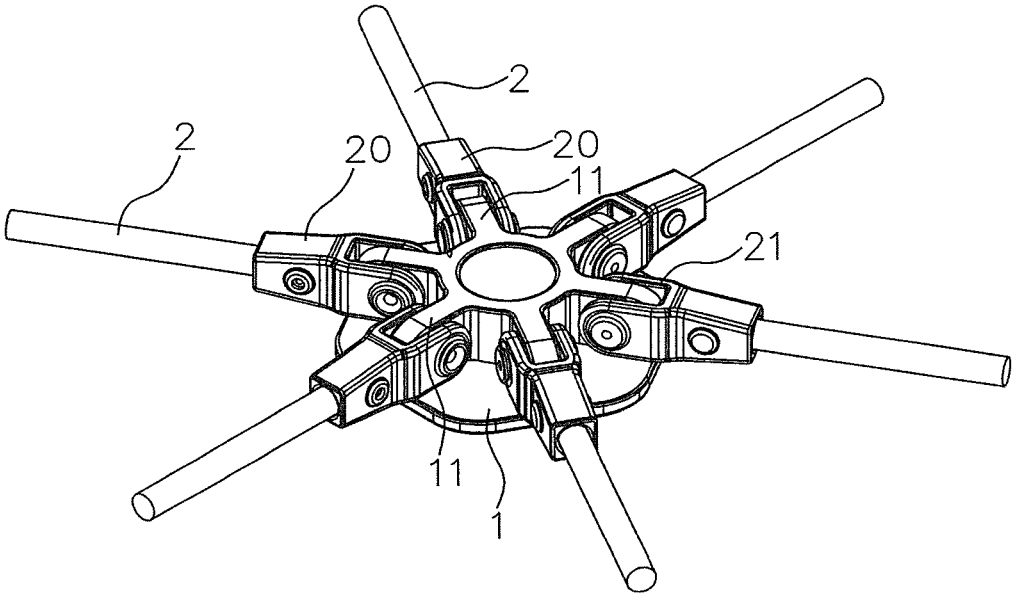
FIG. 7 depicts a structural view illustrating an unfolded state in accordance with one embodiment.
Figure 8:
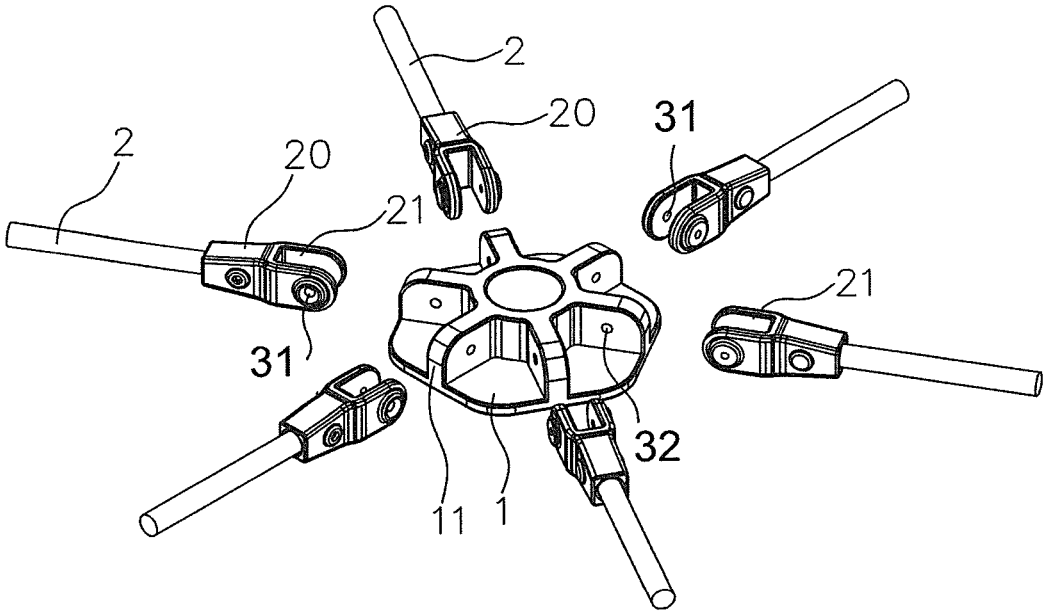
FIG. 8 depicts an exploded structural view in accordance with one embodiment.
Figure 9:
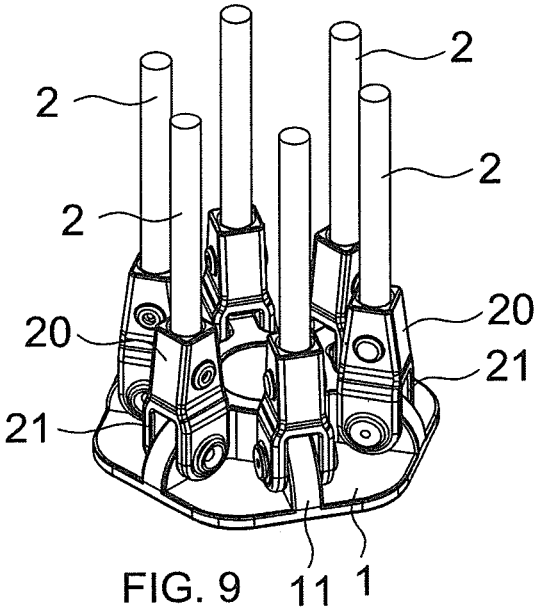
FIG. 9 depicts a schematic view illustrating a folded state in accordance with one embodiment.

Connecting blocks 11 on connecting seat 1 have a number which depends on that of tent top levers 2, as shown in another embodiment depicted in FIGS. 7-9. In this embodiment, six connecting blocks 11 are arranged on connecting seat 1 for connecting with six top levers 2. Connector 20 at the front end of top lever 2 is provided with a pivoting open groove 21 which is directly connected into connecting block 11 so that top levers 2 are pivoted into connecting seat 1.

Connector 20 of top lever 2 is directly pivoted into the respective connecting block 11 of connecting seat 1, and top lever 2 is connected with connecting seat 1 to realize support for unfolding. Thus, connector 20 at the head of top lever 2 is pivotally connected to connecting seat 1 in a simple manner. In this manner, the top connecting apparatus is simple in structure, easy to operate, easy to manufacture, and significantly avoids the problem of unstable connection of the top levers.

Figure 10:
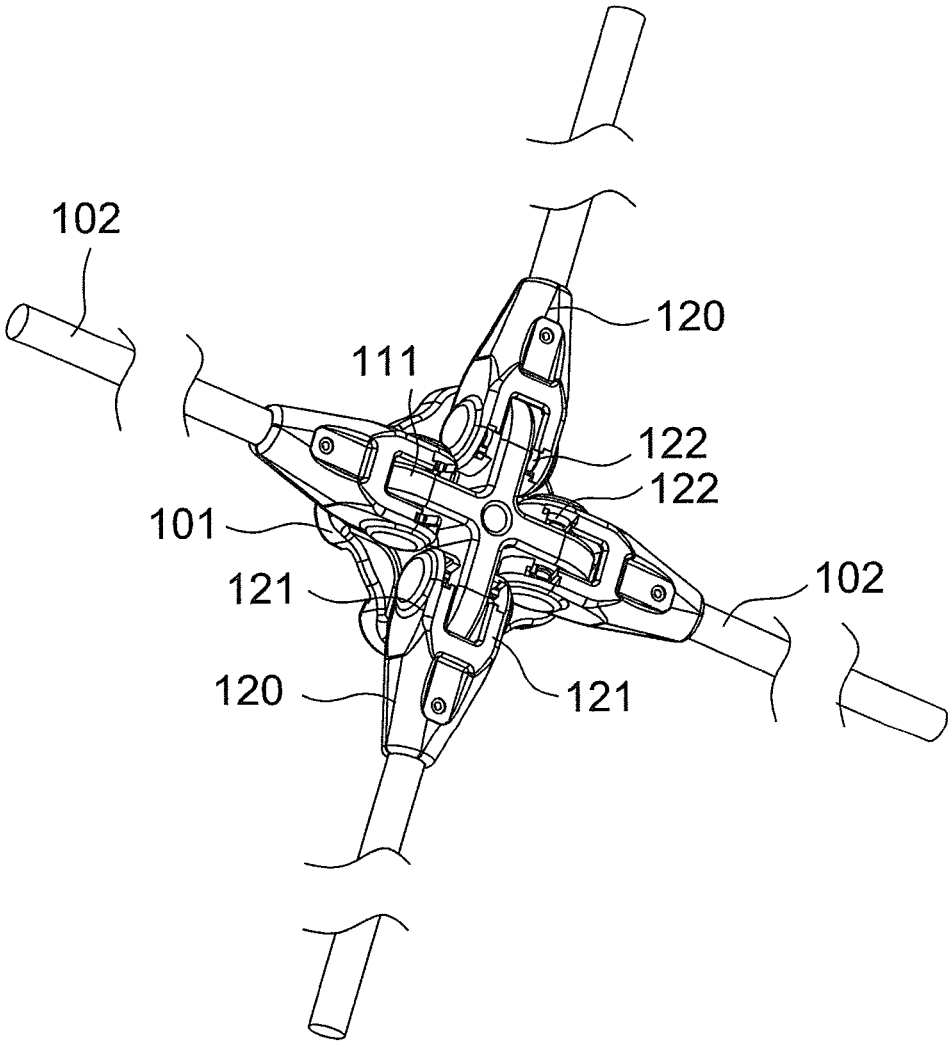
FIG. 10 depicts a structural view illustrating another embodiment.
Figure 11:
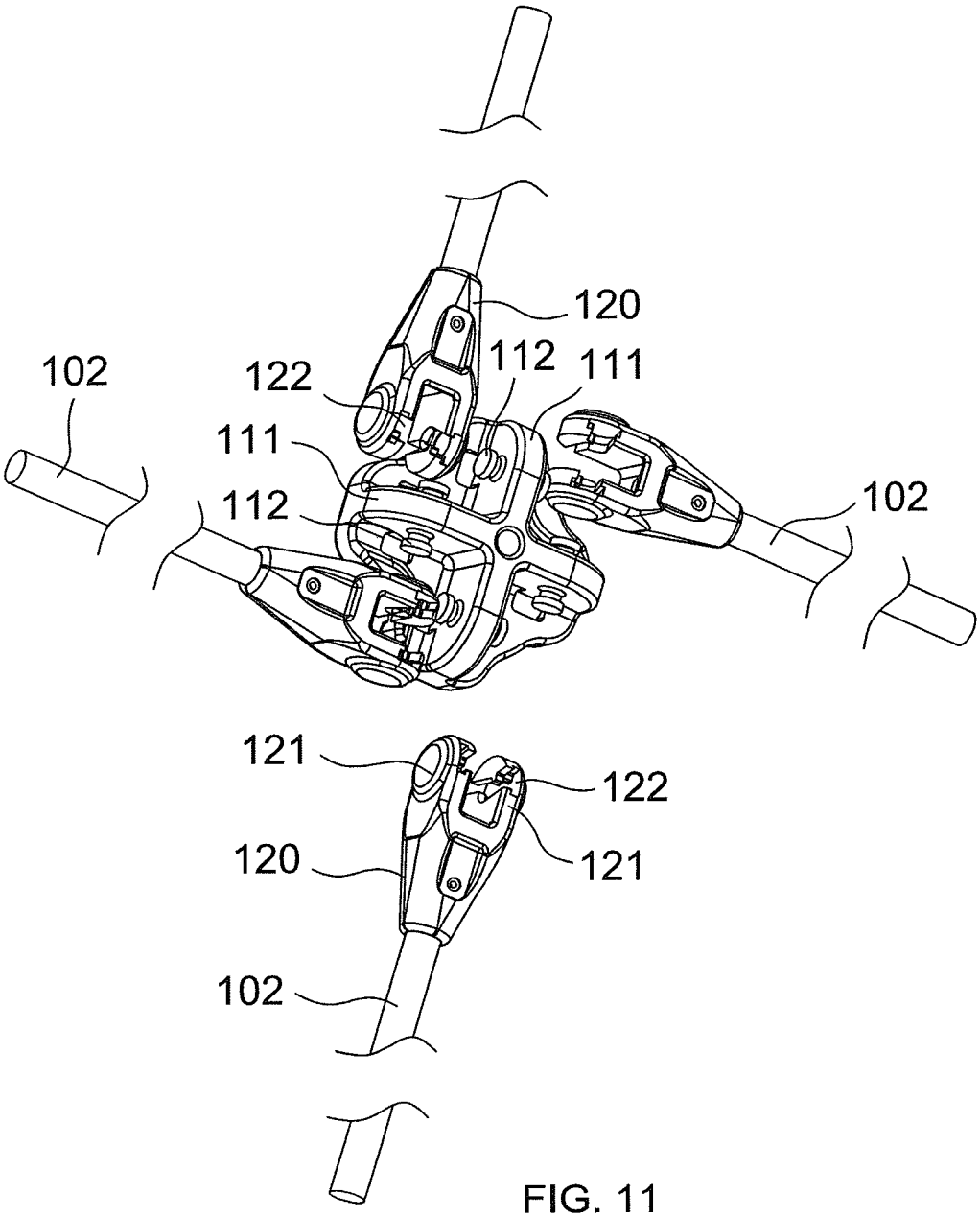
FIG. 11 depicts an exploded schematic view illustrating shelter rods and a top connecting apparatus of another embodiment.
Figure 12:
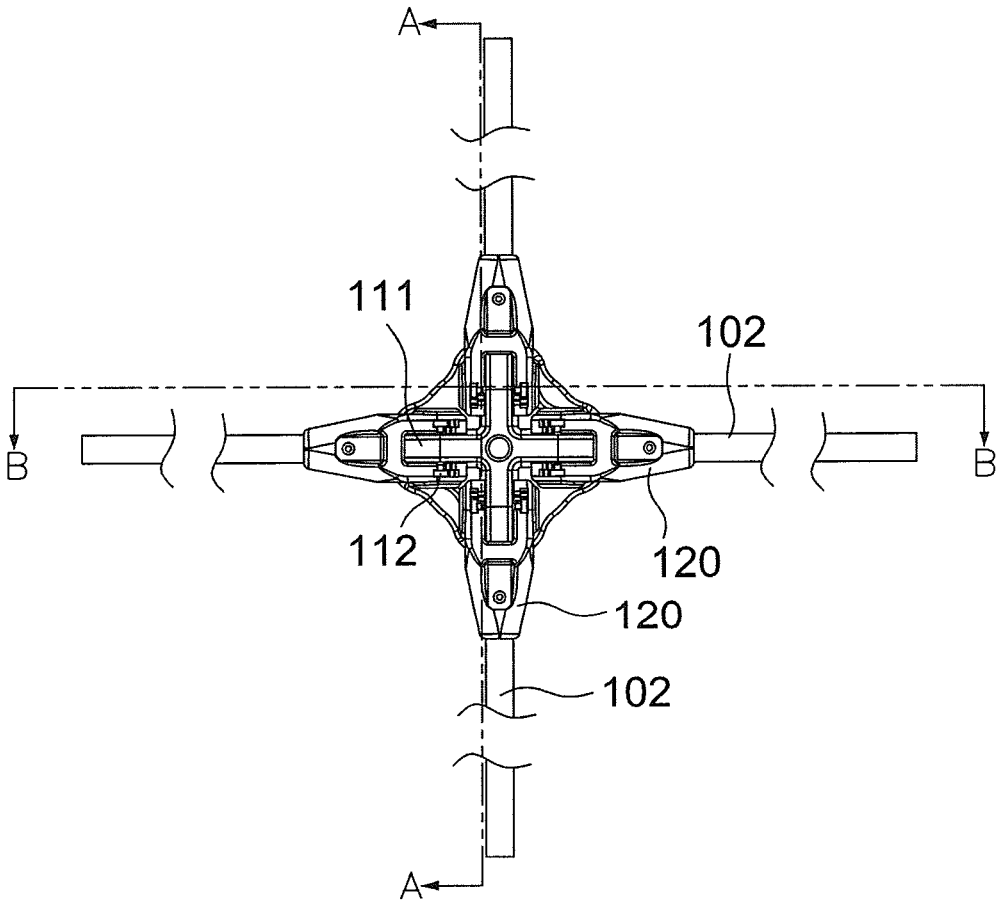
FIG. 12 depicts a top view of another embodiment.

FIGS. 10 and 11 depict a top connecting apparatus in accordance with another embodiment. The apparatus comprises a connecting piece, e.g., connecting seat 101. A plurality of connecting bosses, e.g., strip-shaped connecting blocks 111, are radially arranged along the periphery of connecting seat 101 and have a number corresponding to that of shelter rods, e.g., top levers 102. Connecting block 111 includes first and second sidewalls, a top portion, a bottom portion (adjacent to the connecting piece), an outer portion, an inner portion, and a first pivoting structure. In the embodiment depicted in FIG. 10, four connecting blocks 111 are radially arranged along the periphery of connecting seat 101 for connecting four top levers 102, and the transition between top and outer portions is curved. Four connecting blocks 111 are arranged in a crosswise manner on the connecting seat 101. At a head portion of top lever 102, a pivoting member, e.g., a connector 120, is provided. Connector 120 includes a connecting rod part, which further includes an attachment portion for connecting top lever 102 to the connecting rod part, and a pin hole for securing top lever 102 to the connecting rod part. Connector 120 is pivotally connected to connecting blocks 111 to realize the connection of top levers 102 to connecting seat 101. In connecting seat 101, a baffle is formed at a lower portion of connecting block 111 for limiting the top levers 102 from rotating downward with respect to the connecting seat. The baffle blocks the connection point between connecting blocks 111 and connector 120 in top levers 102, ensuring that top levers 102 are supported in the unfolded state.

In order to pivotally connect top lever 102 with connecting seat 101, top lever 102 is secured into connecting block 111 in an embedded manner by means of connector 120. The first pivoting structure is comprised of first and second positioning pins, e.g., first and second positioning convex pins 112, each having first and second positioning pin cross-sections, and respectively located on a corresponding first and second sidewall of connecting block 111. In other words, two positioning convex pins are arranged, one each symmetrically on either side of connecting block 111. Positioning convex pin 112 is round. A front end of connector 120 is provided with a bifurcated coupler link having a link slot comprising first and second link sidewalls, e.g., an open groove. The bifurcated coupler link includes first and second link sidewalls, and further comprises first and second sheet bodies 121. A second pivoting structure is comprised of first and second longitudinal positioning slots 122, concavely arranged downward and from the top respectively in inner sides of first and second sheet bodies 121. First and second positioning slots 122 are identical and correspond to one other. The bifurcated coupler link in connector 120 can penetrate from top to bottom through the positioning convex pin 112 on connecting blocks 111, so that positioning convex pin 112 is positioned in positioning slot 122 of connector 120. By means of engagement between positioning convex pin 112 and positioning slot 122, connector 120 is positioned onto connecting block 111 on connecting seat 101.

Figure 13:
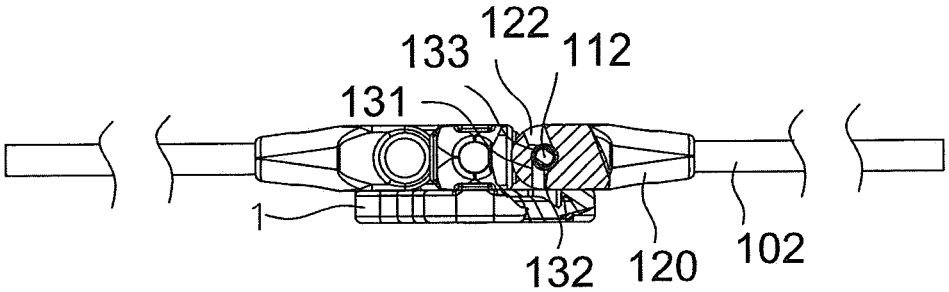
FIG. 13 is a cross-sectional view along line A-A of FIG. 12.
Figure 14:
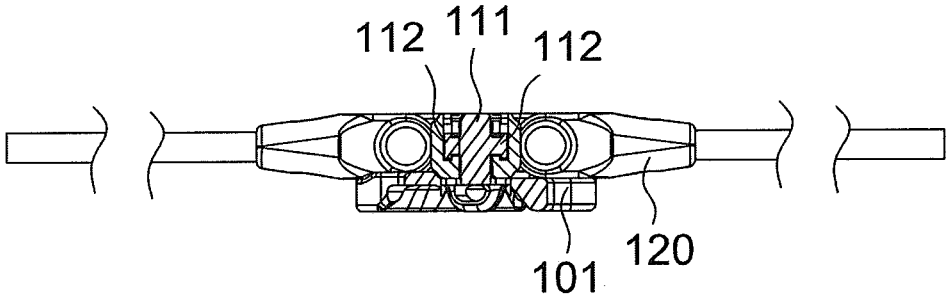
FIG. 14 is a cross-sectional view along line B-B of FIG. 12.
Figure 15:
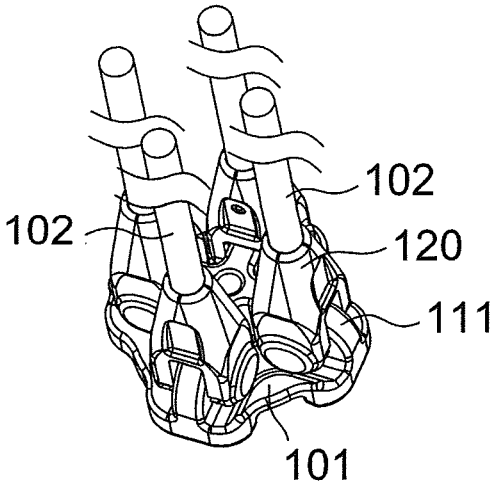
FIG. 15 depicts a schematic view illustrating a folded state of a top connecting apparatus in another embodiment.
Figure 16:
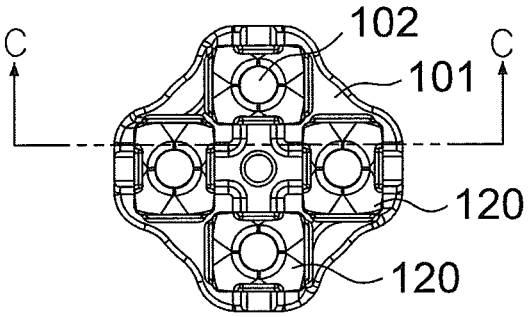
FIG. 16 depicts a top view illustrating a folded state in another embodiment.
Figure 17:
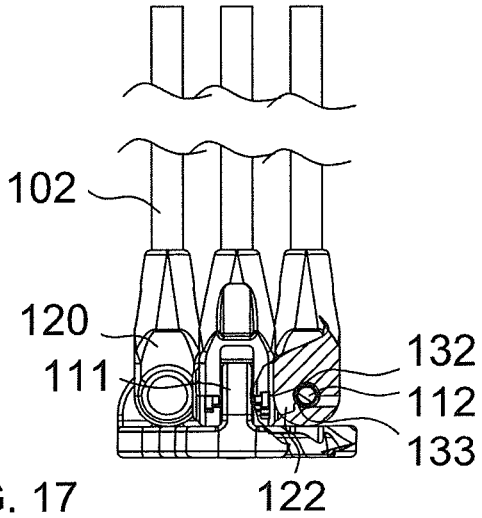
FIG. 17 is a cross-sectional view along line C-C of FIG. 16.
Figure 18:
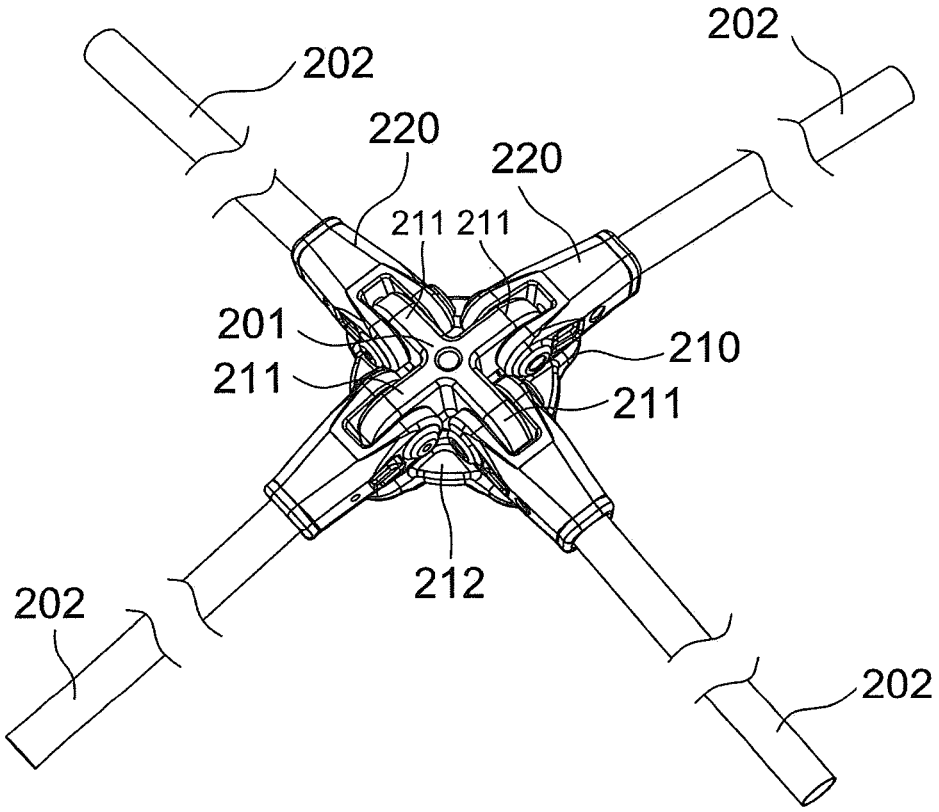
FIG. 18 depicts a perspective structural view illustrating a top connecting apparatus in accordance with another embodiment.
Figure 19:
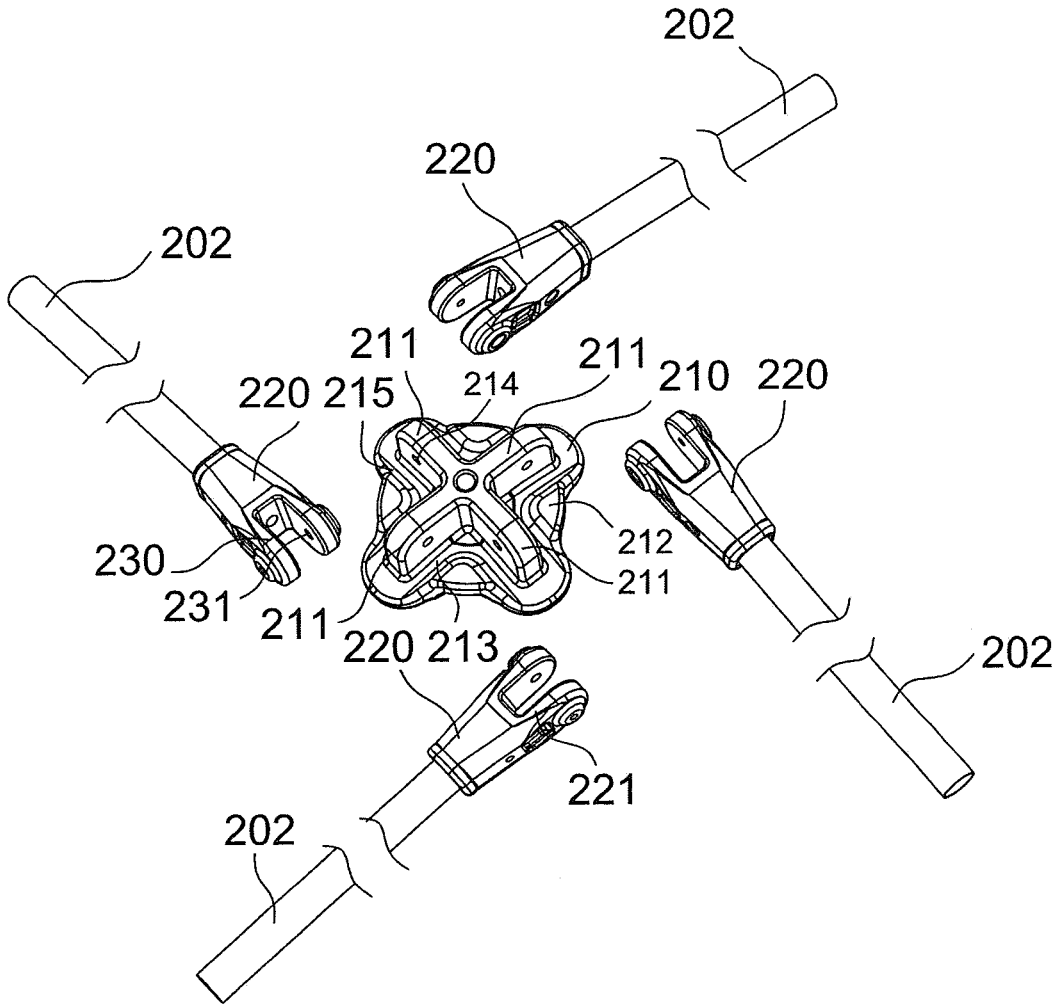
FIG. 19 depicts an exploded structural view illustrating a top connecting apparatus in accordance with another embodiment.
Figure 20:
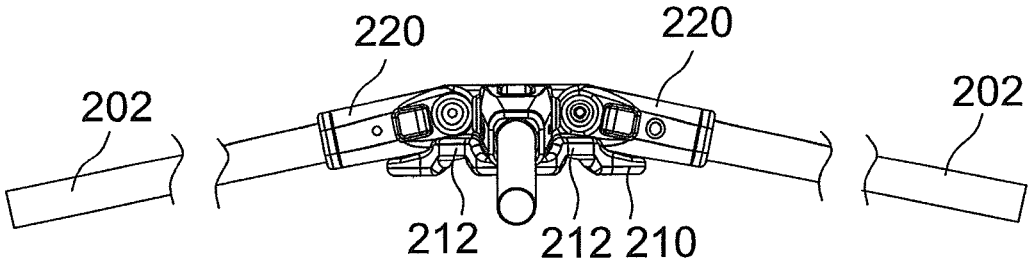
FIG. 20 depicts a side view illustrating a top connecting apparatus in accordance with another embodiment.
Figure 21:
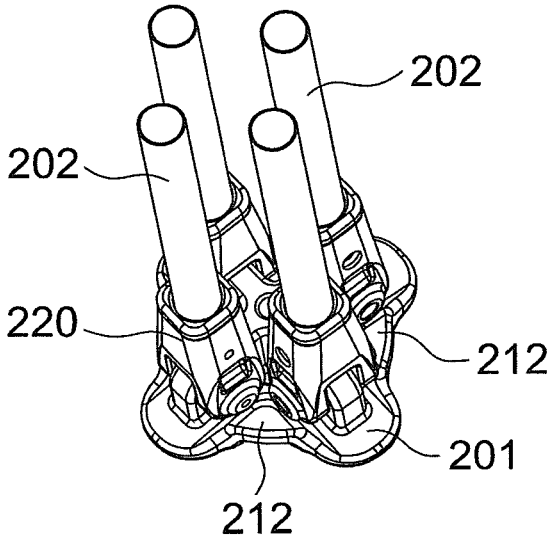
FIG. 21 depicts a schematic view illustrating a folded state of a top connecting apparatus in accordance with another embodiment.

In order to facilitate connecting and positioning of positioning slot 122 into connecting block 111, a curved stop surface 131 (see FIG. 13) is formed on a front longitudinal edge of positioning slot 122, and a curved surface 132 is formed on a back longitudinal edge and acts as a moving fulcrum for the positioning convex pin 112. Curved surface 132 acts as a curved supporting surface on which positioning convex pin 112 can move in a rotatable manner. On the front longitudinal edge, curved stop surface 131 is provided with a convex point 133. The distance from convex point 133 to the back longitudinal edge of the positioning slot is smaller than the diameter of the positioning convex pin 112.

As shown in FIGS. 12-17, when connector 120 (shown connected to a top lever) is connected to connecting blocks 111 of connecting seat 101, connector 120 is inserted onto connecting block 111 so that connecting block 111 lies between first and second sheet bodies 121 of connector 120. When convex point 133 in positioning slot 122 passes positioning convex pin 112, convex point 133 is impacted and temporarily deformed by convex pin 112. Positioning convex pin 112 then becomes embedded into positioning slot 122 in a positioning space formed between convex point 133 and curved surface 132. Therefore, in the unfolded state, connecting seat 101 is directly assembled onto connecting blocks 111. During assembly, curved surface 132 acts as a rotation fulcrum for positioning convex pin 112, and positioning convex pin 112 acts as a moving fulcrum for connector 120. When connector 120 is rotated upward, a stop surface is formed below curved stop surface 131, positioning convex pin 112 is located below the convex point 133 and on curved surface 132, and a positioning space is developed for positioning the positioning convex pin 112. As a result, connecting blocks 111 are fastened in the connector 120, while connector 120 can rotate upward in the connecting blocks so that the top levers 102 can be folded.

Connector 120 at the head portion of top lever 102 is connected with a respective connecting block 111 on connecting seat 101 in an embedded manner. The top connecting apparatus is simple in structure and stable in connection, and can be directly assembled. Top levers 102 are connected into connecting seat 101 to realize the unfolding and folding function, so that connector 120 at the end of top lever 102 is connected into connecting seat 101 in a simple manner. As a result, the top connecting apparatus is simple in structure, low in production cost, and easy to use.

A top connecting apparatus in accordance with another embodiment is depicted in FIGS. 18-21. A connecting piece comprises a connecting seat 201. Connecting seat 201 is provided with a plurality of connecting bosses, e.g., connecting blocks 211, which are radially arranged and have a number corresponding to that of shelter rods, e.g., top levers 202. Connecting block 211 includes first and second sidewalls, a top portion, a bottom portion (adjacent to the connecting piece), an outer portion, an inner portion, and a first pivoting structure. In this embodiment, connecting seat 201 is provided with four connecting blocks 211, which are interconnected, e.g., arranged in a crosswise manner, on connecting seat 201, and the transition between the top and outer portions is curved. At the head portion of top lever 202, pivoting members, e.g., connectors 220, are pivotally connected to connecting blocks 211, thus realizing the connection of top levers 202. Connector 220 includes a connecting rod part, which further includes an attachment portion for connecting top lever 202 to the connecting rod part, and a pin hole for securing top lever 202 to the connecting rod part. Connector 220 is provided with a bifurcated coupler link having a link slot comprising first and second link sidewalls, e.g., a pivoting open groove 221. Pivoting open groove 221 is pivoted into connecting block 211, so that top lever 202 is pivoted into connecting seat 201.

Pivoting open groove 221 and connecting block 211 are pivotally interconnected by a pin. In this case, the first pivoting structure provided in connecting block 211 comprises a connecting hole, e.g., a pivoting hole 214, which penetrates through connecting block 211 Pivoting hole 214 is arranged near the center of connecting block 211. A second pivoting structure comprising pivoting hole 231 and a pin (not shown) is further provided. Pivoting hole 231 is arranged on first and second corresponding sheet bodies 230 of pivoting open groove 221 at a position facing pivoting hole 214. A pin (not shown) is connected between pivoting hole 214 and pivoting hole 231. Pivoting open groove 221 is pivotally connected to connecting block 211 of connecting seat 201 by the pin, so that top levers 202 are connected to connecting seat 201. A baffle 210 is arranged at a lower portion of connecting block 211 in connecting seat 201 for limiting top lever 202 from rotating downward with respect to the connecting seat. It is necessary for baffle 210 to block a pivoting point between connecting blocks 211 and connector 220 in top levers 202, ensuring that top levers 202 are supported in the unfolded state.

When connector 220 is connected to connecting seat 201, in order to connect pivoting open groove 221 to connecting block 211 in a more stable manner, a lateral boss 212 comprising first and second profile planes, e.g., sidewalls, is adjacent to a corresponding two, e.g., arranged between, neighboring connecting blocks 211 in connecting seat 201. Lateral boss 212 is arranged on baffle 210. A triangular bump 215 lies between two connecting blocks 211, thereby forming the first and second sidewalls of lateral boss 212. A stabilizing groove, e.g., a strip-shaped groove 213, is developed between each first and second sidewall of lateral boss 212 and the corresponding adjacent second and first sidewall of connecting blocks 211. First and second sheet bodies 230 of pivoting open groove 221 exactly lie in the strip-shaped groove 213, so that both sides of pivoting open groove 221 rest between lateral bosses 212 on both sides. As a result, when connector 220 of the top lever connected into connecting blocks 211, i.e., pivoting open groove 221 in connector 220 is connected onto connecting blocks 211 of connecting seat 201, pivoting open groove 221 is positioned between lateral bosses on both sides. Under the positioning effect of lateral bosses 212, connector 220 can be connected in a more stable manner and is not susceptible to swaying.

When the shelter, e.g., tent, is unfolded, pivoting open groove 221 at the head portion of top lever 202 is connected into connecting block 211 on connecting seat 201, and the lower end of pivoting open groove 221 rests against connecting seat 201. When the top levers 202 of the tent are folded, connector 220 is folded upward.

Connector 220 of top lever 202 is directly pivoted into connecting blocks 211 of connecting seat 201 so that top levers 202 are connected into the connecting seat 201 and are supported to unfold. As a result, connector 220 is pivotally connected to connecting seat 201 in a simpler manner, and the top connecting apparatus is simpler in structure. Moreover, in connecting seat 201, a lateral boss 212 is provided for positioning connector 220. Connector 220 is positioned between lateral bosses 212 on both sides. Under the positioning effect of lateral bosses 212, connector 220 can be connected in a more stable manner, and the top levers connected by the top connecting apparatus will not be susceptible to swaying, so that the tent stand is more stable.

Figure 22:
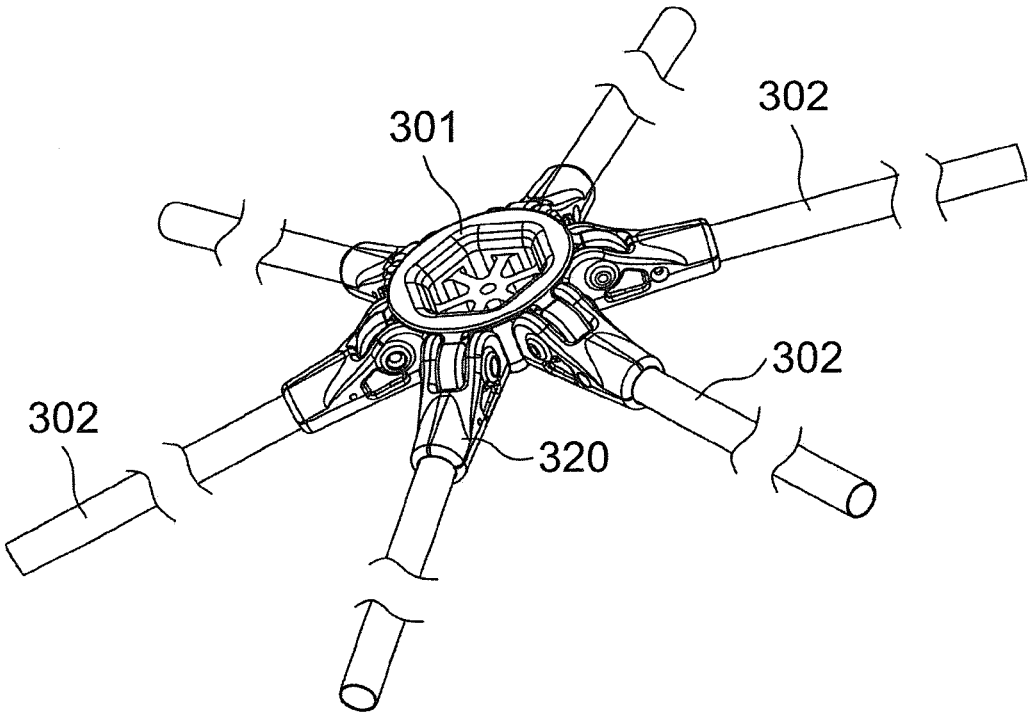
FIG. 22 depicts a structural view illustrating a top connecting apparatus in accordance with another embodiment.
Figure 23:
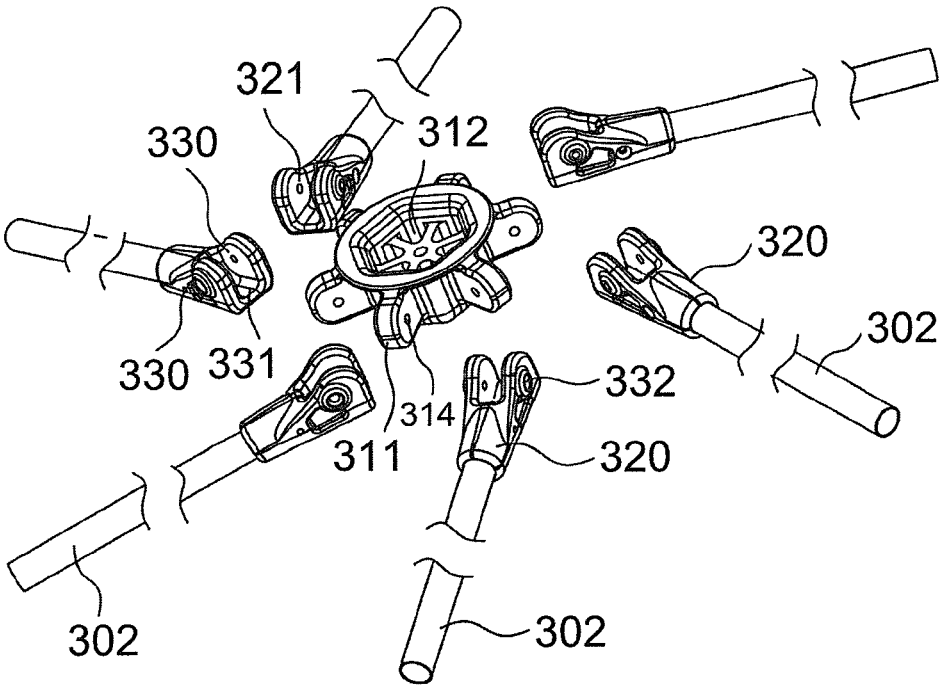
FIG. 23 depicts an exploded schematic view illustrating a shelter rod and a top connecting apparatus in accordance with another embodiment.
Figure 24:
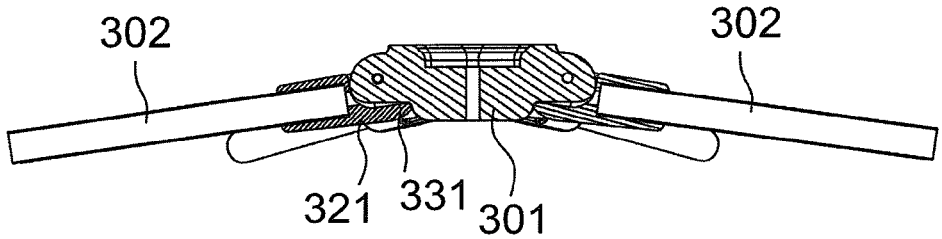
FIG. 24 is a sectional side view of FIG. 22.
Figure 25:
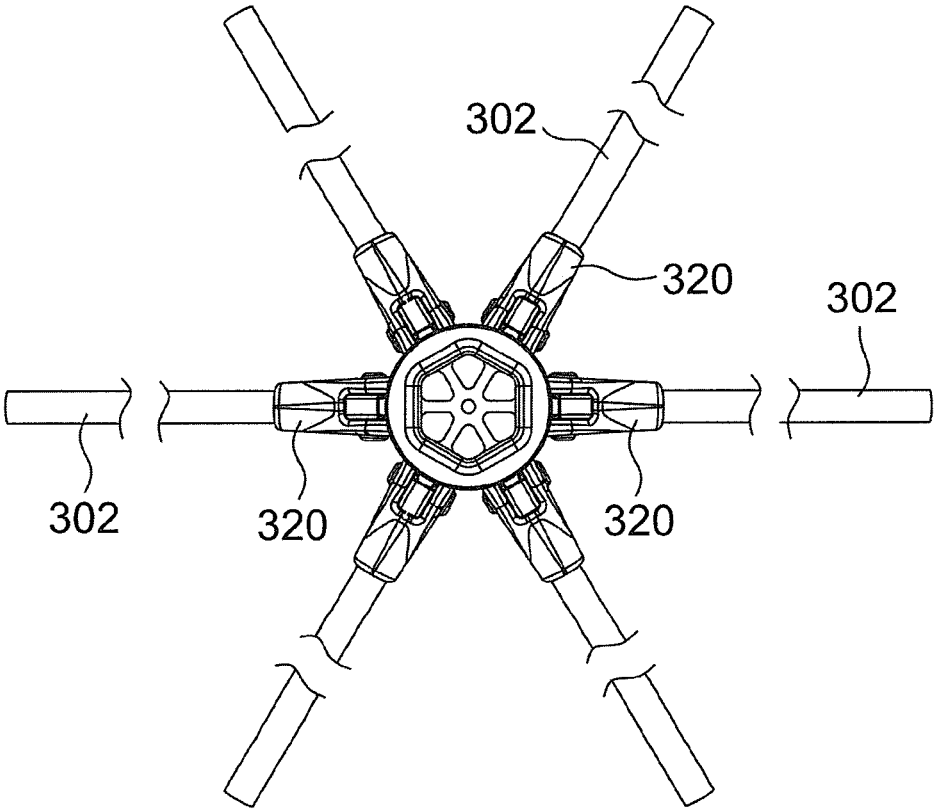
FIG. 25 depicts a top view illustrating a top connecting apparatus in accordance with another embodiment.
Figure 26:
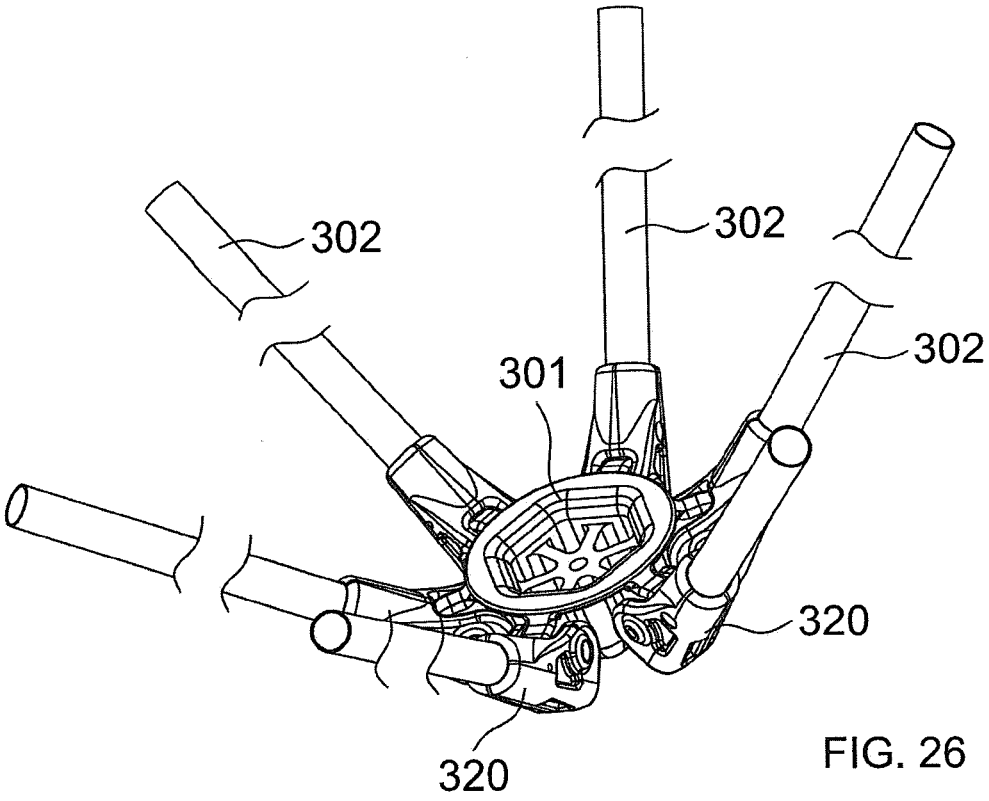
FIG. 26 depicts a schematic view illustrating a half-folded state of a top connecting apparatus in accordance with another embodiment.
Figure 27:
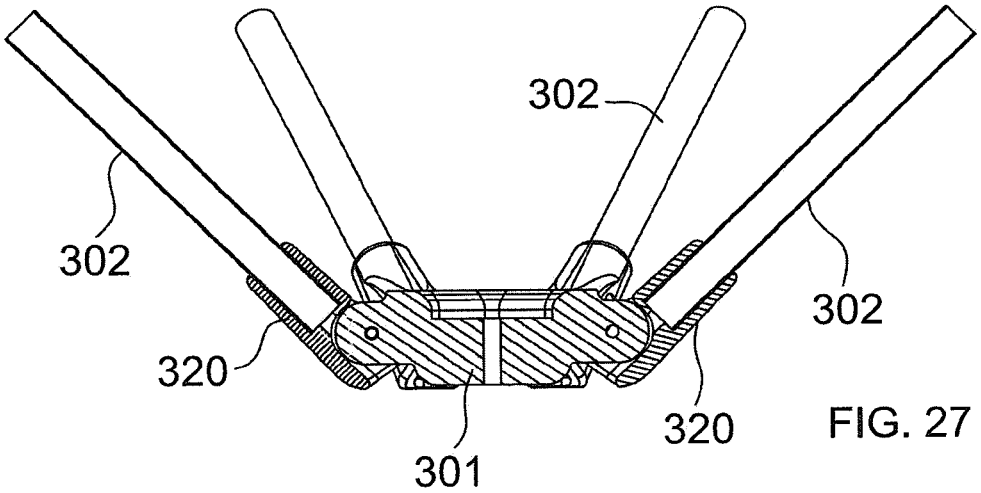
FIG. 27 is a sectional side view of FIG. 26.
Figure 28:
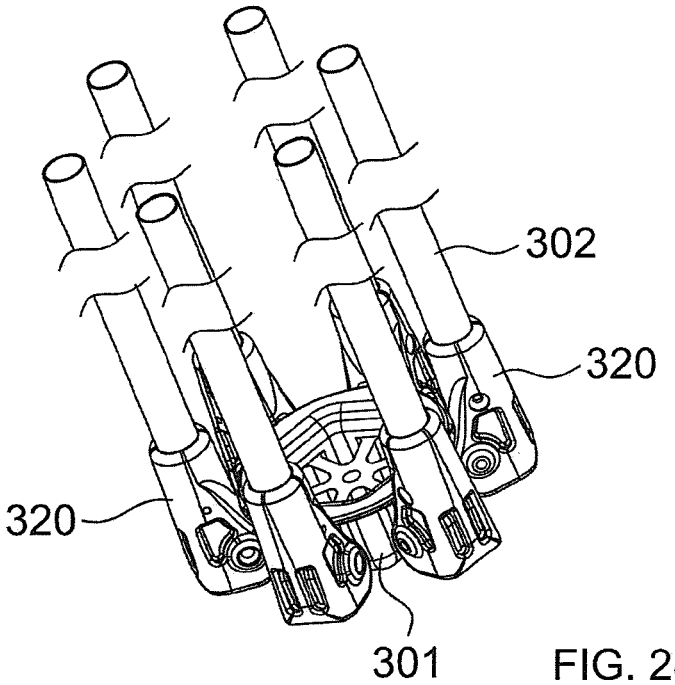
FIG. 28 depicts a schematic view illustrating a folded state of a top connecting apparatus in accordance with another embodiment.
Figure 29:
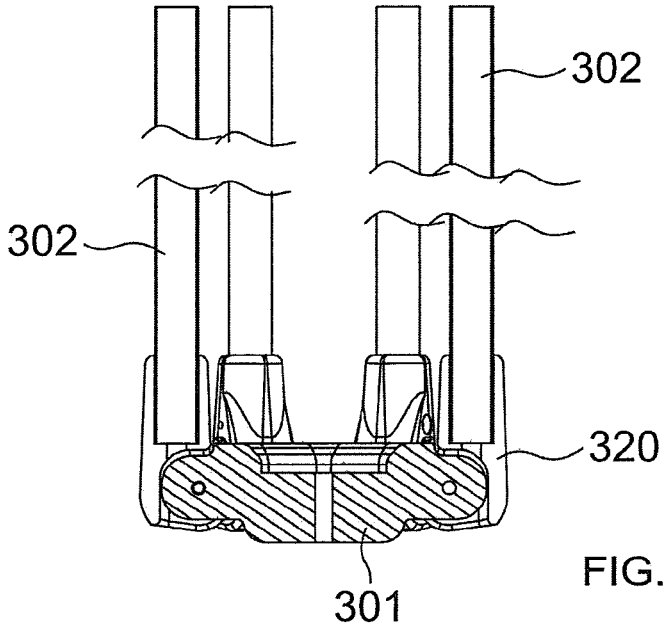
FIG. 29 is a sectional side view of FIG. 28.

A top connecting apparatus for folding and unfolding a shelter, e.g., a tent, is depicted in FIGS. 22-23 in accordance with another embodiment. The apparatus comprises a round-shaped connecting piece, e.g., a connecting seat 301. A plurality of connecting bosses, e.g., strip-shaped connecting blocks 311, are radially arranged on the periphery of connecting seat 301 and have a number corresponding to that of shelter rods, e.g., top levers 302, of the tent. Connecting block 311 includes first and second sidewalls, a top portion, a bottom portion (adjacent to the connecting piece), an outer portion, an inner portion, and a first pivoting structure. As depicted in FIG. 23, six connecting blocks 311 are radially arranged along the periphery of connecting seat 301 for connecting six top levers 302, and the transition between the top and outer portions is curved. A pivoting member, e.g., connector 320 is provided to pivotally interconnect top lever 302 to connecting block 311. Connector 320 includes a connecting rod part, which further includes an attachment portion for connecting top lever 302 to the connecting rod part, and a pin hole for securing top lever 302 to the connecting rod part. Connector 320 further includes a bifurcated coupler link having a link slot comprising first and second sidewalls, e.g., a U-shaped groove 321. By pivoting the U-shaped groove 321 into respective connecting block 311, top lever 302 is pivotally interconnected to connecting seat 301. Furthermore, an upper periphery of connecting seat 301 is formed as a center pedestal, e.g., a blocking ledge 312, which extends outward. When top levers 302 are folded upward in connecting seat 301, the upward-folded top levers 302 vertically rest against connecting seat 301 due to the blocking effect of blocking ledge 312, so that top levers 302 cannot be folded inward. When top levers 302 lean against one other in a folded state, the top levers will not huddle together in disorder, thus avoiding a problem in which tent rod members are messy when folded.

As depicted in FIGS. 22-29, U-shaped groove 321 and connecting blocks 311 can be pivotally interconnected by means of pillars, e.g., pins. In this case, the first pivoting structure provided in connecting block 311 comprises a connecting hole, e.g., a pivoting hole 314, which penetrates through connecting block 311. Pivoting hole 314 is arranged near the center of connecting block 311. In connector 320, U-shaped groove 321 further comprises first and second sheet bodies 330, and a link baffle plate 331. The link baffle plate 331 lies between first and second sheet bodies 330, so that a U-shaped groove structure is formed in front of connector 320. When the U-shaped groove 321 is connected to connecting seat 301, connecting block 311 is exactly inserted into U-shaped groove 321. A second pivoting structure comprising a pivoting hole 332 and a pin (not shown) is provided in connector 320. Pivoting hole 332 is provided on first and second sheet bodies 330 at a position facing pivoting hole 314. A pin (not shown) is connected between pivoting hole 314 and pivoting hole 332.

By pivotally connecting U-shaped groove 321 into connecting block 311 of connecting seat 301 by the pin, top levers 302 are connected to connecting seat 301. Since the U-shaped groove structure is adopted in connector 320 for connecting with connecting blocks 311, the link baffle plate 331 rests below connecting blocks 311 when the top lever 302 is unfolded. The link baffle plate 331 performs such a limiting function that, in the unfolded state of top levers 302, connector 320 cannot be further folded downward, ensuring that top levers 302 are supported to unfold. It is not necessary to arrange a baffle structure on connecting seat 301, since the link baffle plate 331 of the U-shaped groove 321 in connector 320 is able to limit the unfolded connector, and top levers 302 can therefore be stably supported to unfold. When top levers 302 of the tent are folded, connector 320 is folded upward. In this manner, the top connecting apparatus is more convenient, and the top connecting apparatus is simpler in overall structure, stable in connection, and easy to use.

Figure 30:
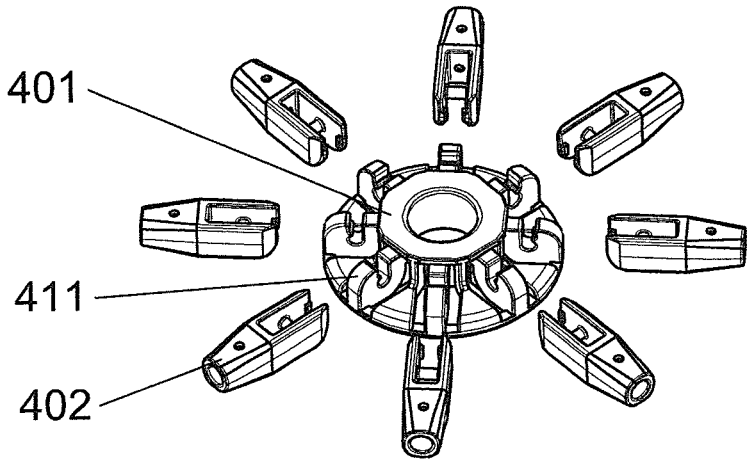
FIG. 30 depicts an exploded view of a top connecting apparatus in accordance with another embodiment.

FIG. 30 depicts a top connecting apparatus in accordance with another embodiment. The apparatus includes a connecting piece 403, e.g., a pedestal, on which is radially arranged a plurality of connecting bosses 411, e.g., pin joints. A central pedestal 401, concentric to connecting piece 403, is joined to connecting bosses 411 and connecting piece 403. A plurality of pivoting members 402, e.g., pin joint pieces, pivotally interconnect with a corresponding one of connecting bosses 411. Pivoting member 402 includes an attachment portion 428, e.g., a mounting hole, by which pivoting member 402 is attached to a shelter rod. Typically, the apparatus is provided with one pivoting member 402 for each connecting boss 411. FIG. 30 depicts, e.g., eight of each. A skilled artisan will appreciate that fewer pivoting members than connecting bosses, e.g., two, may also be provided.

Figure 31:
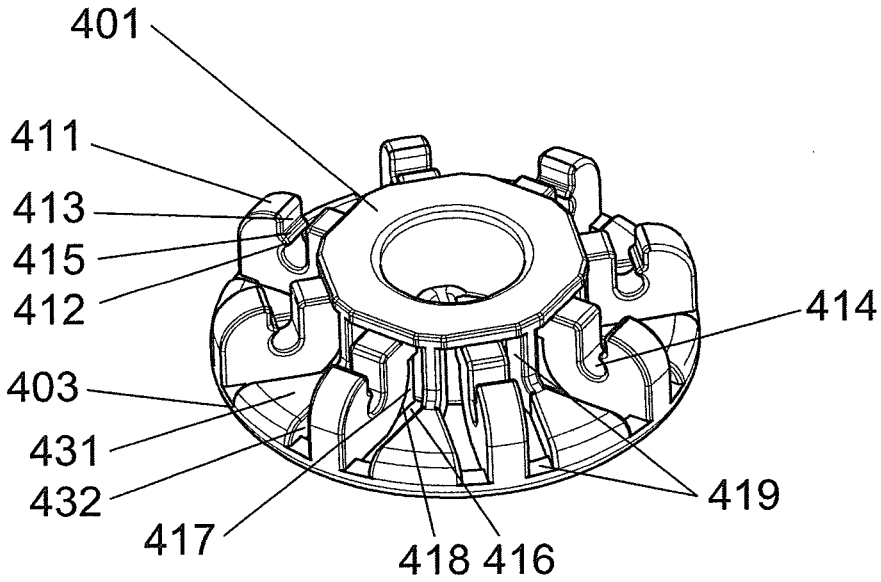
FIG. 31 depicts a structure of a central pedestal of a top connecting apparatus in accordance with another embodiment.

In accordance with one embodiment depicted in FIG. 31, connecting boss 411 includes first and second sidewalls, a top portion, a bottom portion (adjacent to the connecting piece), an outer portion, an inner portion, and a first pivoting structure, e.g., a connecting slot 413. As depicted, the transition between the top and outer portions is curved. Connecting slot 413 runs between the first and second sidewalls of connecting boss 411, and includes first and second slot walls, a slot bottom, and a slot opening. The slot opening opens at the top portion of connecting boss 411. An arc surface 414 is located at the slot bottom. An embossment 412 includes a convex point and, above the convex point, a guiding surface 415. Embossment 412 is located on the first slot wall of connecting slot 413. A positioning space is thereby formed between embossment 412 and arc surface 414 sufficient to accommodate a pillar cross-section, e.g., a pin cross-section, for pivotally attaching pivoting member 402 to connecting boss 411. In the embodiment depicted in FIG. 31, the second slot wall of connecting slot 413 (opposite the first slot wall) includes no embossment.

Connecting boss 411 includes a female buckle structure 416, the female buckle structure including a groove 417 and an arc gear face 418 concentric with the arc surface 414. Groove 417 and arc gear face 418 engage with a lug 426 of pivoting member 402, e.g., to aid in attaching (assembling) pivoting member 402 to connecting boss 411. Arc gear face 418 subtends a quadrant arc, e.g., it provides for an approximate quarter turn rotation of pivoting member 402.

Central pedestal 401 is also arranged with limit surfaces 419 adjacent to connecting boss 411 to impose a limit on a rotation angle between pivoting member 402 and connecting boss 411. As depicted in FIG. 31, a first limit surface 419 located adjacent to the exterior bottom portion of connecting boss 411, and a second limit surface 419 located adjacent to the interior top portion of connecting boss 411, are perpendicular, thereby limiting the rotation angle between pivoting member 402 and the connecting boss 411 to, e.g., 90°.

Figure 32:
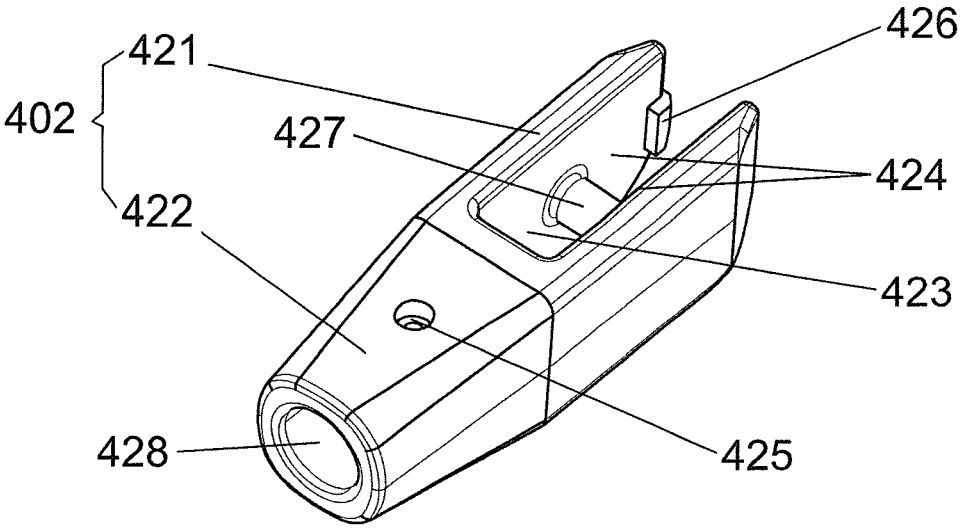
FIG. 32 depicts a structure of pivoting members of a top connecting apparatus in accordance with another embodiment.

In accordance with an embodiment as depicted in FIG. 32, pivoting member 402 comprises a bifurcated coupler link 421 coordinating with connecting boss 411, and a connecting rod part 422 coordinating with a shelter rod. Bifurcated coupler link 421 includes link slot 423, comprising first and second link sidewalls 424. Male buckle structures including first and second lugs 426, for engaging with female buckle structures 416, are arranged on link sidewalls 424. After installation, each of first and second lugs 426 is engaged in a corresponding groove 417 of female buckle structures 416, and becomes movable along arc gear face 418. Link slot 423 is sized to accommodate connecting boss 411, and includes a second pivoting structure, e.g., pillar 427, e.g., a pin. Each end of pillar 427 is fixed on a corresponding link sidewall 424 of link slot 423. Pillar 427 engages connecting slot 413, thereby pivotally interconnecting pivoting member 402 to connecting boss 411. Preferably, the diameter of pillar 427 is slightly less than that of arc surface 414, thus, pillar 427 is clamped on arc surface 414 firmly by embossment 412.

Connecting rod part 422 includes attachment portion 428, e.g., a mounting hole, or a threaded hole, for attaching, e.g., threading, a shelter rod, and further includes a pin hole 425 for securing the shelter rod to the connecting rod part 422.

Referring again to FIG. 31, each of a plurality of radially arranged lateral bosses 431 is located adjacent to a corresponding two of the radially arranged connecting bosses 411. In other words, lateral bosses 431 are "in between" connecting bosses 411. Lateral boss 431 includes first and second profile planes 432. Lateral boss 431 is positioned such that each first and second profile plane is parallel to and spaced from a corresponding first and second sidewall of a respective adjacent connecting boss 411. The space thereby formed on either side of connecting boss 411 accommodates a cross-section of bifurcated coupler link 421 sufficient to prevent pivoting member 402 from waggling against connecting boss 411.

To assemble the apparatus, pivoting member 402 is pivotally connected to connecting boss 411. Pillar 427 is first buckled into connecting slot 413. Lugs 426 also engage with respective grooves 417. Pillar 427 next moves along connecting slot 413 toward embossment 412. As pillar 427 moves toward embossment 412, it is guided by guiding surface 415. As pillar 427 moves past embossment 412, embossment 412 temporarily and elastically deforms, then recovers its original shape. Pillar 427 is thereafter clamped between embossment 412 and arc surface 414. The post-assembly state of the apparatus is depicted in FIG. 33.

Figure 33:
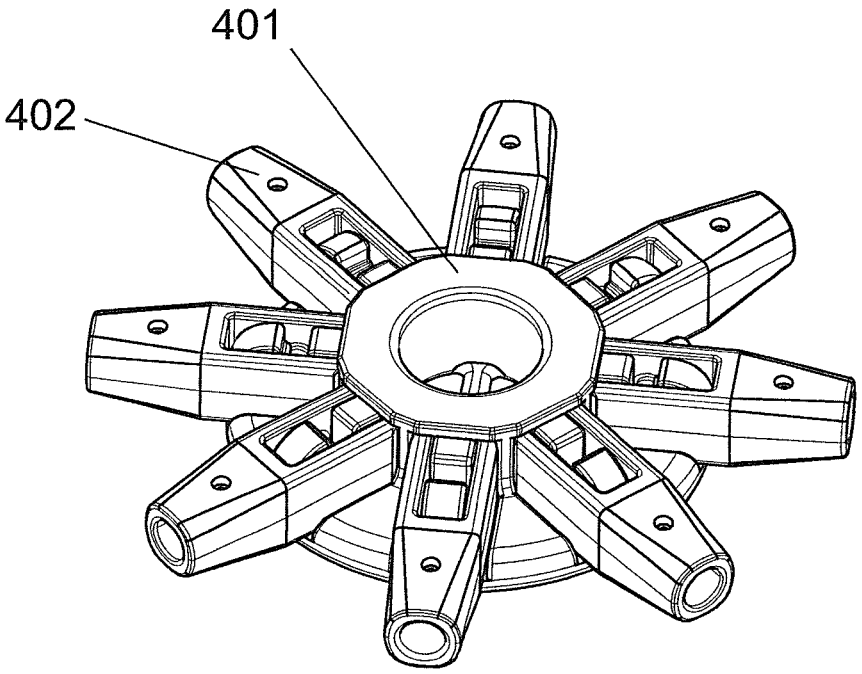
FIG. 33 depicts a post-assembly structure of a top connecting apparatus in accordance with another embodiment.
Figure 34:
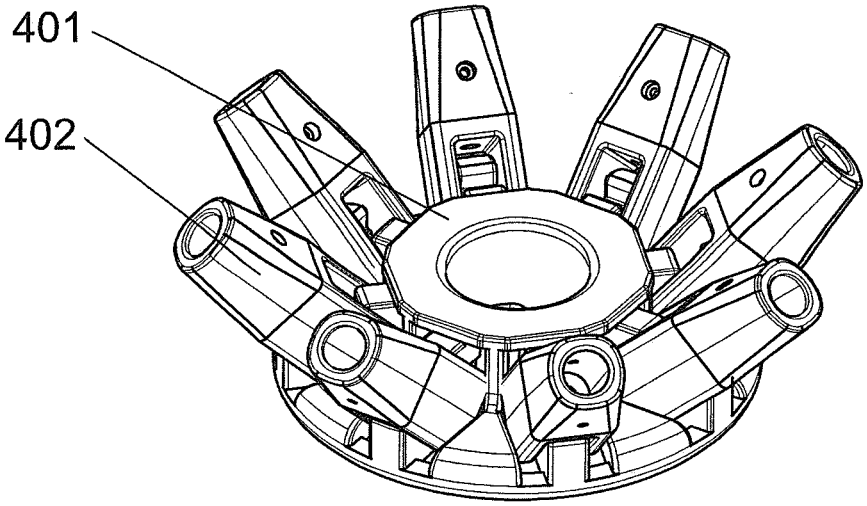
FIG. 34 depicts a rotational state of a top connecting apparatus in accordance with another embodiment.
Figure 35:
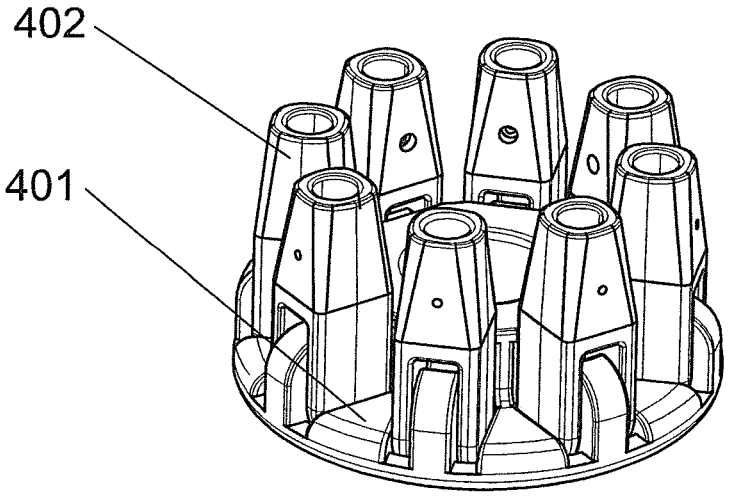
FIG. 35 depicts another rotational state of a top connecting apparatus in accordance with another embodiment.
Figure 36:
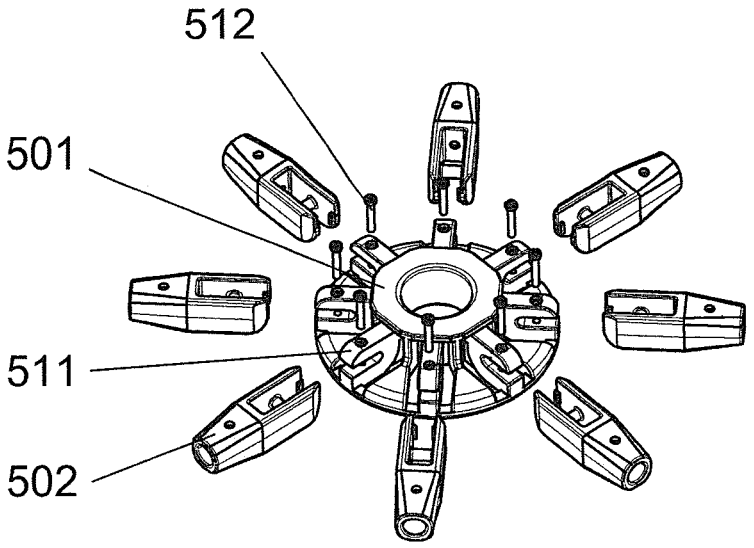
FIG. 36 depicts an exploded view of a top connecting apparatus in accordance with another embodiment.

As shown in FIGS. 33, 34, and 35, pivoting members 402 may freely rotate within the limits imposed (approximately a quarter rotation) by the two perpendicularly oriented limit surfaces 419. FIG. 33 depicts the apparatus (e.g., connection status between central pedestal 401 and pivoting members 402) in an unfolded state, i.e., after unfolding a shelter, e.g., a tent. FIG. 34 depicts the apparatus during a folding operation, and FIG. 35 depicts the apparatus in a folded state.

FIGS. 36-41 depict a top connecting apparatus in accordance with additional embodiments. Reference numerals 501-503, 511, 514, 516-519, 521-528, and 531-532 of FIGS. 36-41 correspond to reference numerals 401-403, 411, 414, 416-419, 421-428, and 431-432 of FIGS. 30-35, and to the subject matter of the related foregoing text. Accordingly, a description of like elements is omitted for brevity. A description of embodiments relating to unlike elements, including screw 512, connecting slot 513, and screw hole 515, follows.

Figure 37:
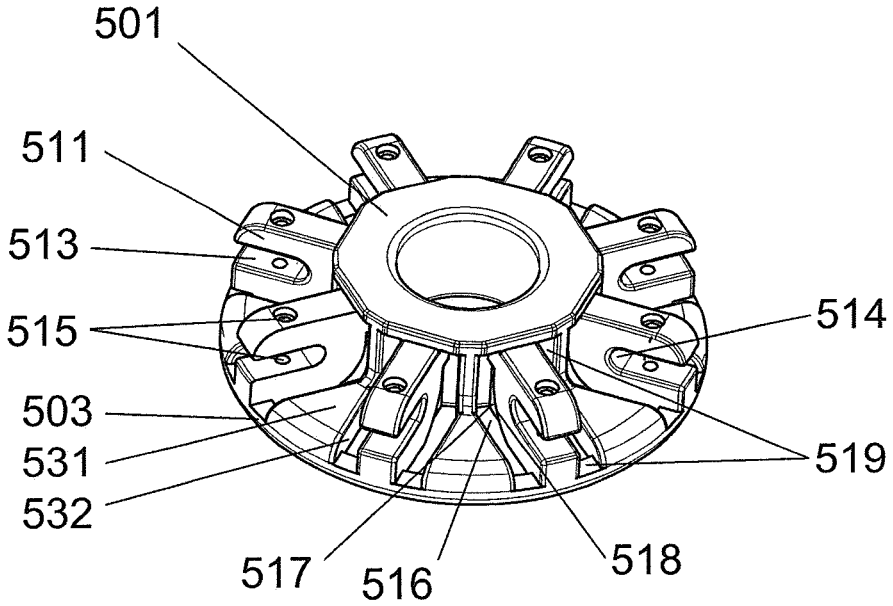
FIG. 37 depicts a central pedestal in a top connecting apparatus with screw in accordance with another embodiment.
Figure 38:
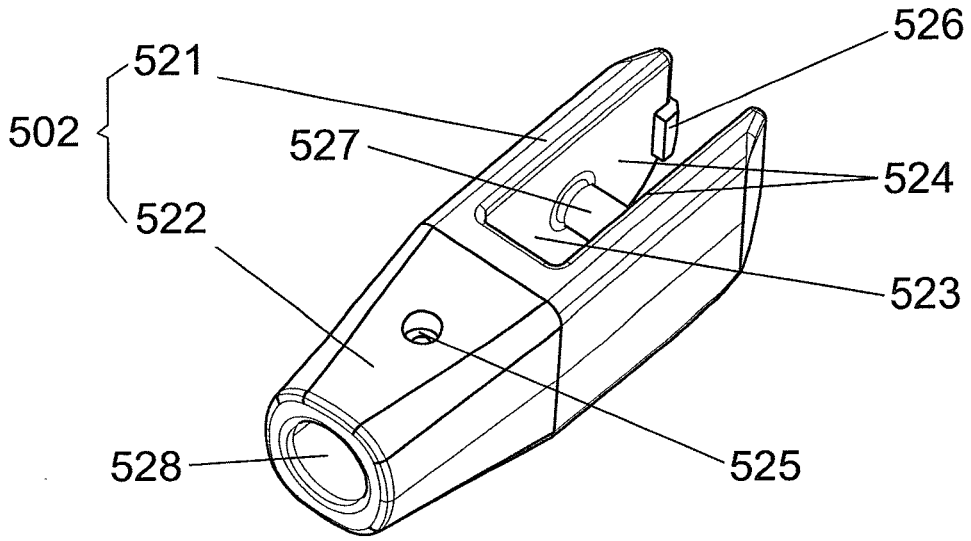
FIG. 38 depicts a pin joint pieces in a top connecting apparatus in accordance with another embodiment.

In accordance with one embodiment depicted in FIG. 37, connecting boss 511 includes first and second sidewalls, a top portion, a bottom portion (adjacent to the connecting piece), an outer portion, an inner portion, and a first pivoting structure, e.g., a connecting slot 513. Connecting slot 513 runs between the first and second sidewalls of connecting boss 511, and includes first and second slot walls, a slot bottom, and a slot opening. The slot opening opens at the outer portion of connecting boss 511. An arc surface 514 is located at the slot bottom. A first screw hole 515 is located on the first slot sidewall at a second distance from the arc surface, a second screw hole 515 is located on the second slot sidewall at the second distance from the arc surface, and a screw 512 connects the first and second screw holes. A positioning space is thereby formed between screw 512 and arc surface 514 sufficient to accommodate a pillar cross-section, e.g., a pin cross-section, for pivotally attaching pivoting member 502 to connecting boss 511.

Figure 39:
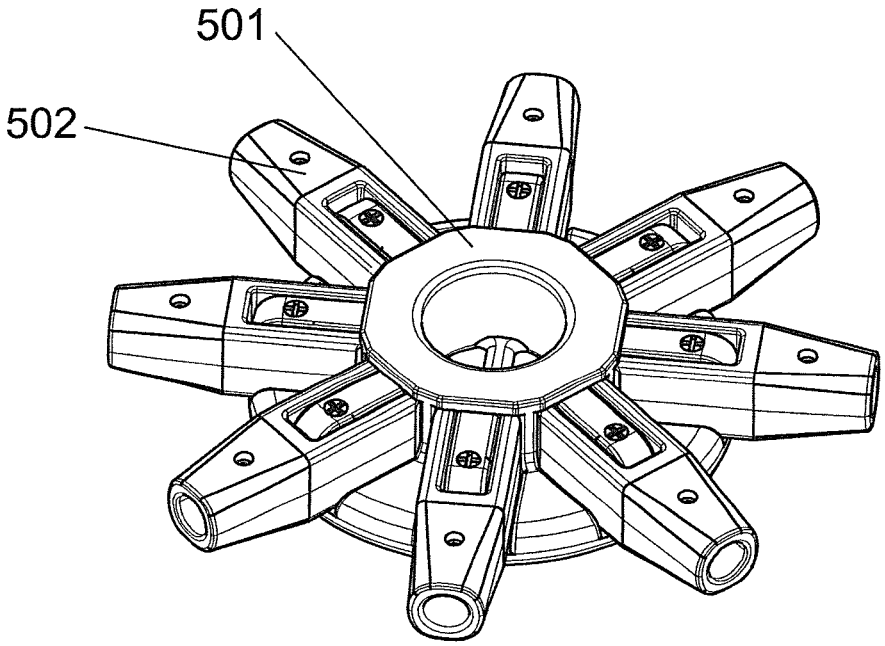
FIG. 39 depicts a post-assembly structure of a top connecting apparatus in accordance with another embodiment.
Figure 40:
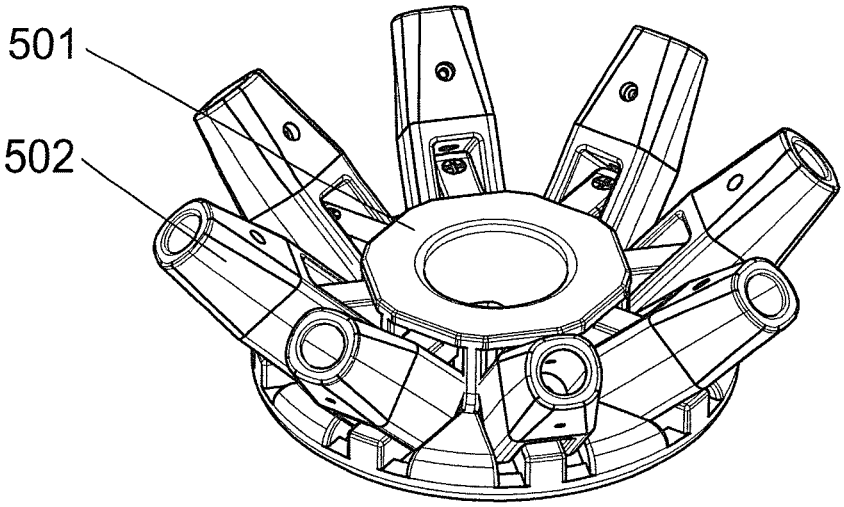
FIG. 40 depicts a rotational state of a top connecting apparatus in accordance with another embodiment.
Figure 41:
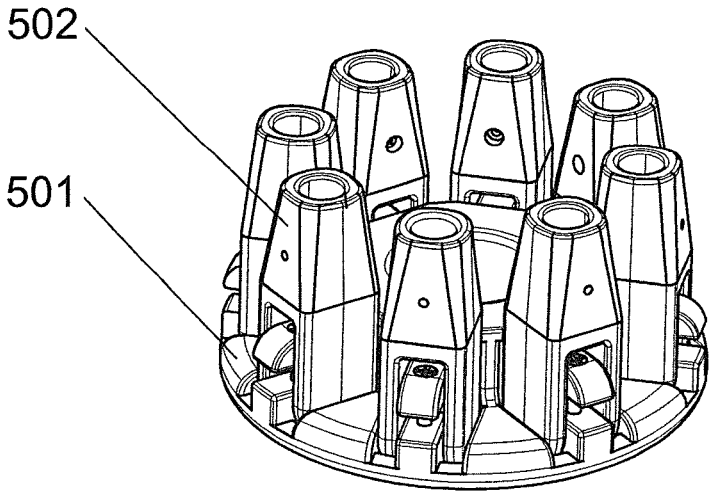
FIG. 41 depicts another rotational state of a top connecting apparatus in accordance with another embodiment.

As shown in FIGS. 39, 40, and 41, pivoting members 502 may freely rotate within the limits imposed (approximately a quarter rotation) by the two perpendicularly oriented limit surfaces 519. FIG. 39 depicts the apparatus (e.g., connection status between central pedestal 501 and pivoting members 502) in an unfolded state, i.e., after unfolding a shelter, e.g., a tent. FIG. 40 depicts the apparatus during a folding operation, and FIG. 41 depicts the apparatus in a folded state.

While the present invention has been described in connection with specific embodiments, variations of these embodiments are also envisioned. For example, more or fewer connecting bosses 411, 511, and pivoting members 402, 502 than described be may arranged on connecting pieces 403, 503, and, e.g., screw 515 may be replaced by a non-threaded pin. Other modifications and variations likewise fall within the scope of the appended claims. Therefore, the spirit and scope of the appended claims should not be limited to the foregoing description.

Only those claims specifically reciting "means for" or "step for" should be construed in the manner required under the sixth paragraph of 35 U.S.C. §112.

What is claimed is:

1. A top connecting apparatus for placing a shelter in a folded and an unfolded state, the apparatus comprising:

a connecting piece comprising a plurality of radially arranged connecting bosses, each connecting boss comprising:

first and second sidewalls, a top portion, a bottom portion, an outer portion, an inner portion, and a first pivoting structure comprising a first connecting slot, wherein the first connecting slot comprises:

first and second slot walls, a slot opening, a slot bottom, an arc surface located at the slot bottom;

a first screw hole located on the first slot wall at a distance from the arc surface, a second screw hole located on the second slot wall at the distance from the arc surface, and a screw connecting the first and second screw holes, thereby forming a positioning space between the screw and the arc surface sufficient to accommodate a pillar cross-section; and a first pivoting member comprising a connecting rod part, the connecting rod part comprising:

an attachment portion that attaches a shelter rod to the first pivoting member, a bifurcated coupler link comprising a link slot that comprises first and second link sidewalls, and a second pivoting structure comprising a pillar connected with the first and second link sidewalls, wherein the pillar is received in the positioning space of a corresponding connecting boss, thereby pivotally interconnecting the first pivoting member with the corresponding connecting boss.

2. The connecting apparatus of claim 1, wherein the slot opening opens at the outer portion of the connecting boss.

3. The connecting apparatus of claim 1, further comprising a central pedestal, the central pedestal concentric to the connecting piece and joined to the inner portions of the connecting bosses.

4. The connecting apparatus of claim 1, further comprising a plurality of radially arranged lateral bosses, each lateral boss in the plurality of radially arranged lateral bosses is adjacent to two connecting bosses.

5. The connecting apparatus of claim 4, wherein one or each lateral boss further comprises first and second profile planes, and wherein each of the first and second profile planes is respectively parallel to a corresponding adjacent second or first sidewall.

6. The connecting apparatus of claim 1, wherein the connecting piece is round.

7. The connecting apparatus of claim 1, wherein the plurality of connecting bosses is eight.

8. The connecting apparatus of claim 1, further comprising a first limit surface and a second limit surface corresponding to one or each connecting boss, wherein the first limit surface is located adjacent to an exterior portion of the bottom portion of the corresponding connecting boss, and the second limit surface is located adjacent to an interior portion of the top portion of the corresponding connecting boss.

9. The connecting apparatus of claim 8, wherein the first and second limit surfaces are perpendicular.

10. The connecting apparatus of claim 1, wherein the link slot of the first pivoting member further comprises first and second lugs located on the first and second link sidewalls, respectively.

* * * * *